US005942981A

United States Patent [19]

Kackman

[11] Patent Number: 5,942,981

[45] Date of Patent: Aug. 24, 1999

[54] LOW BATTERY DETECTOR FOR A WIRELESS SENSOR

[75] Inventor: Gerald M. Kackman, St. Paul, Minn.

[73] Assignee: Interactive Technologies, Inc., North St. Paul, Minn.

[21] Appl. No.: 08/599,087

[22] Filed: Feb. 9, 1996

[51] Int. Cl.[6] ..... G08B 21/00

[52] U.S. Cl. ..... 340/636; 320/48; 371/37.1

[58] Field of Search ..... 340/636; 371/37.1; 370/338, 445; 320/48

[56] References Cited

U.S. PATENT DOCUMENTS

| | | | |
|---|---|---|---|
| 4,672,365 | 6/1987 | Gehman et al. | 340/539 |
| 4,737,770 | 4/1988 | Brunius et al. . | |
| 4,761,648 | 8/1988 | Ellis | 340/539 |
| 4,855,713 | 8/1989 | Brunius . | |
| 4,906,055 | 3/1990 | Horiuchi | 320/48 |
| 4,947,484 | 8/1990 | Twitty et al. | 371/37.1 |
| 4,951,029 | 8/1990 | Severson . | |
| 5,302,902 | 4/1994 | Groehl | 320/48 |
| 5,331,318 | 7/1994 | Montgomery | 340/885.4 |
| 5,363,071 | 11/1994 | Schwent et al. | 333/111 |
| 5,410,536 | 4/1995 | Shah et al. | 370/13 |
| 5,506,572 | 4/1996 | Hills et al. | 340/636 |
| 5,512,890 | 4/1996 | Everson, Jr. et al. | 340/870.13 |
| 5,559,499 | 9/1996 | Haubner | 340/636 |
| 5,602,831 | 2/1997 | Gaskill | 370/252 |

OTHER PUBLICATIONS

DiGiacomo, G. *Metal Migration (Ag. Cu. Pb) in Encapsulated Modules and Time–to–Fail Model as a Function of the Environement and Package Properties,* IEEE/PROC. IRPS, pp. 27–33 (1982).

*Primary Examiner*—Jeffery A. Hofsass
*Assistant Examiner*—John Tweel, Jr.
*Attorney, Agent, or Firm*—Fish & Richardson P.C., P.A.

[57] ABSTRACT

Measuring the critical value of a parameter of a sensor in a security system (e.g., battery voltage) is performed at a time when the critical value is most likely to be reached, and the critical value information is sent from the sensor to a system controller at a time when the information is most likely to be successfully received.

30 Claims, 46 Drawing Sheets

*Fig. 4A*

| | |
|---|---|
| Fig. 4A-1 | Fig. 4A-2 |

*Fig. 4B*

| | |
|---|---|
| Fig. 4B-1 | Fig. 4B-2 |
| Fig. 4B-3 | Fig. 4B-4 |

*Fig. 4C*

| | |
|---|---|
| Fig. 4C-1 | Fig. 4C-2 |
| Fig. 4C-3 | Fig. 4C-4 |

*Fig. 4D*

| | |
|---|---|
| Fig. 4D-1 | Fig. 4D-2 |
| Fig. 4D-3 | Fig. 4D-4 |

21
PUBEN
VDD
1 PREBAR
1 D
1 Q
F4DB
1 CLK
1 QBAR
1 CLRBAR
VDD
1 PREBAR
24
1 D
1 Q
TRG4L
1 CLK
1 QBAR
NOENL
1 CLRBAR
25
NOEN
1 PREBAR
VSS
1 D
1 Q
F4LTCH
1 CLK
1 QBAR
X
1 CLRBAR
XMTL

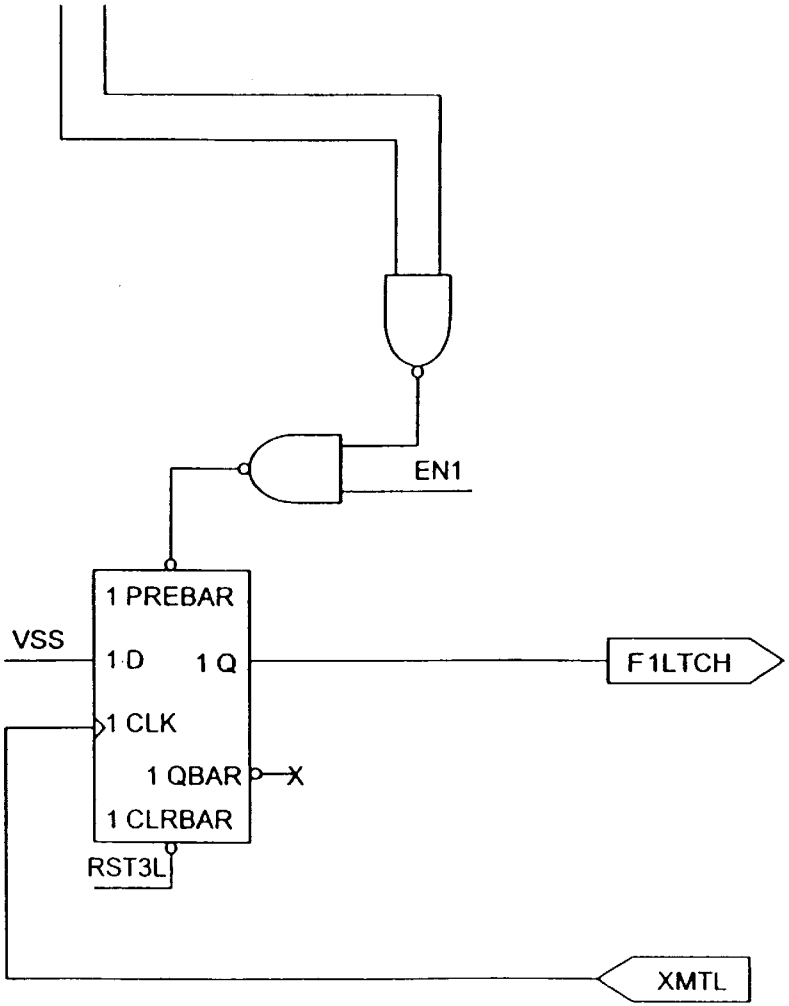
*Fig. 4B-4*
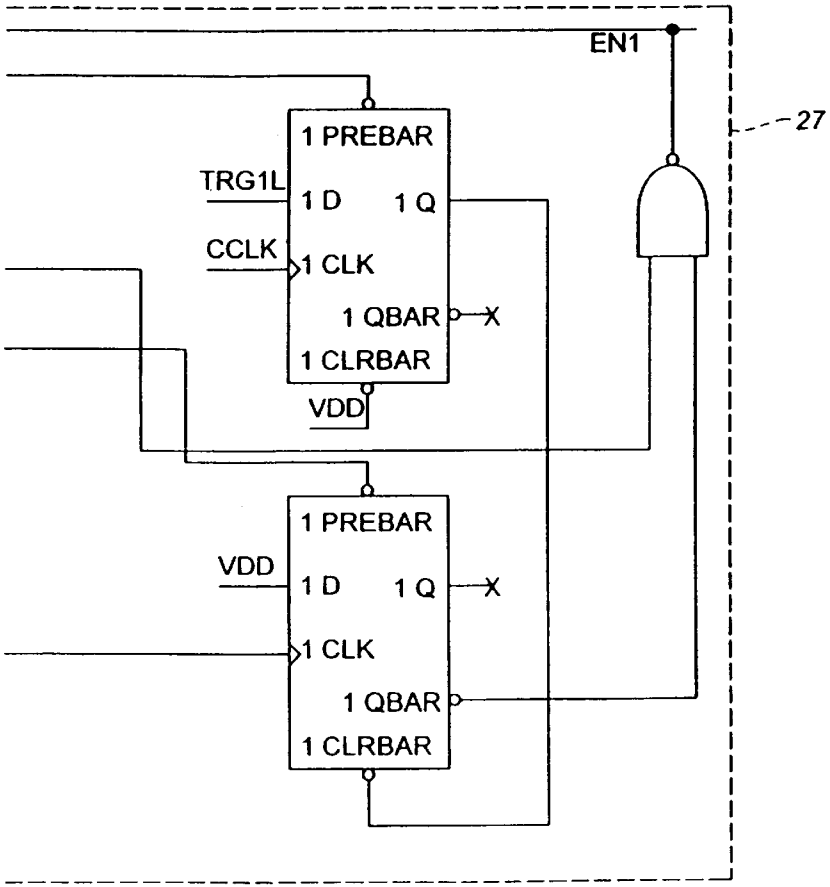

| | |
|---|---|
| FIG. 6A | FIG. 6B |
| FIG. 6C | FIG. 6D |
| FIG. 6E | FIG. 6F |

| | |
|---|---|
| FIG. 7A | FIG. 7B |
| FIG. 7C | FIG. 7D |

| | |
|---|---|
| FIG. 8A | FIG. 8B |
| FIG. 8C | |

| | | |
|---|---|---|
| FIG. 9A | FIG. 9B | FIG. 9C |
| FIG. 9D | FIG. 9E | FIG. 9F |
| FIG. 9G | FIG. 9H | FIG. 9I |
| FIG. 9J | FIG. 9K | |

LOW BATTERY DETECTOR FOR A WIRELESS SENSOR

BACKGROUND OF THE INVENTION

This invention relates to monitoring a critical value of a parameter and sending the critical value to a system controller.

Sensing devices, such as those in a security system, send messages to a system controller, which then interprets the messages and generates a response. The sensors are typically remote from the system controller and have a separate energy source, such as a battery. Since the energy source of the system controller and remote sensors are separate, the system controller has no information on whether any of the remote sensors have adequate battery power to send messages to the system controller.

Additionally, the energy level varies during operation of the sensor. When the sensors are not generating messages, the energy requirements are minimal. However, the energy requirements increase when generating and sending messages. In a battery-powered sensor, the battery voltage typically decreases during the active period as the sensor is generating and sending messages. The voltage may recover during a following period when no activity is detected by the sensor. In a system where the sensor generates a series of message packets each time the sensor is activated, the battery will typically have its highest voltage when generating the first message packet and the lowest level when generating the last message packet.

The sensor energy level or other important parameter should be transmitted to the system controller at a time when the information is most likely to be successfully communicated to the system controller, i.e., when the battery voltage is highest. Once a low battery condition is detected in a battery-powered sensor, sending the low-battery information in one of the latter packets reduces the likelihood that the system controller will receive and decode the information. The low battery information should be sent at a time when the battery has recovered and is more likely to have sufficient energy to generate a message that is successfully received and decoded by the system controller.

SUMMARY OF THE INVENTION

The present invention is directed to a method and apparatus for measuring a parameter and sending a message to a system controller including the value of the parameter.

A method is provided for measuring a parameter at a time when a critical value of the parameter is more likely to occur, and sending a message reporting the value of the parameter over a communication channel to a system controller when the message is more likely to be successfully communicated. The parameter is an energy level such as battery power. Also, the energy level decreases during the sending of messages. Additionally, a prior message is sent ahead of a message, the parameter is measured during the sending of the prior message, and the critical value is more likely to be reached near the end of the prior message.

Additionally, the critical value is an energy level at which the message will not be successfully communicated. Additionally, the message includes a group of message packets, the energy or battery level is measured during the last packet of a prior message, and the battery or energy level is reported in the first packet of a next succeeding group of packets.

Additionally, the invention includes a method of detecting a low-power level of a sensor which sends groups of message packets, including measuring a power level of the sensor near the end of sending a first group of message packets, and sending the measured power level as part of a next succeeding group of message packets. Additionally, the method includes measuring the battery level near the end of the last packet of the first group. Additionally, the method includes comparing the measured power level with a predetermined reference value. Additionally, the method includes sending the power level as part of each message packet of a next succeeding group.

Additionally, the invention includes a low-battery detector for a battery-powered sensor which sends message packets to a system controller. The detector includes a reference voltage, a comparator connected to the reference voltage and a battery of the sensor and adapted to generate an output signal indicative of the battery level, and a transmitter, operably connected to the comparator, for including the output signal in a next succeeding group of packets. Additionally, the output signal indicates whether the battery level is above or below a reference voltage. Additionally, the apparatus includes a packet counter for counting the number of packets in a group and generating a signal when the last packet in a group is counted, and where the comparator is enabled by the last packet signal.

The invention provides several advantages. The critical value, e.g., energy or battery level, is measured at a time when the parameter is most likely to reach its critical value. For example, when a battery-powered sensor generates a group of message packets, the battery will most likely be at its lowest voltage level at the end of generating the last packet.

Additionally, when a critical value is detected, that value is transmitted at a time when the value is most likely to be successfully communicated. Again using the example of a remote sensor, if the sensor reaches the low battery value at the end of sending a message, then the latter part of the message may not be successfully received by a system controller. When the sensor is sending a group of message packets, the battery may reach the critical value at the last few packets. Therefore, it would not be advantageous to send the low battery signal with the last few packets. In the present invention, the critical value, e.g., the low battery value, is saved and sent with a later message when the battery has recovered and the sensor is no longer operating below the critical value.

Other advantages and features will become apparent from the following description and claims.

DESCRIPTION OF THE EMBODIMENTS

Figure 11:
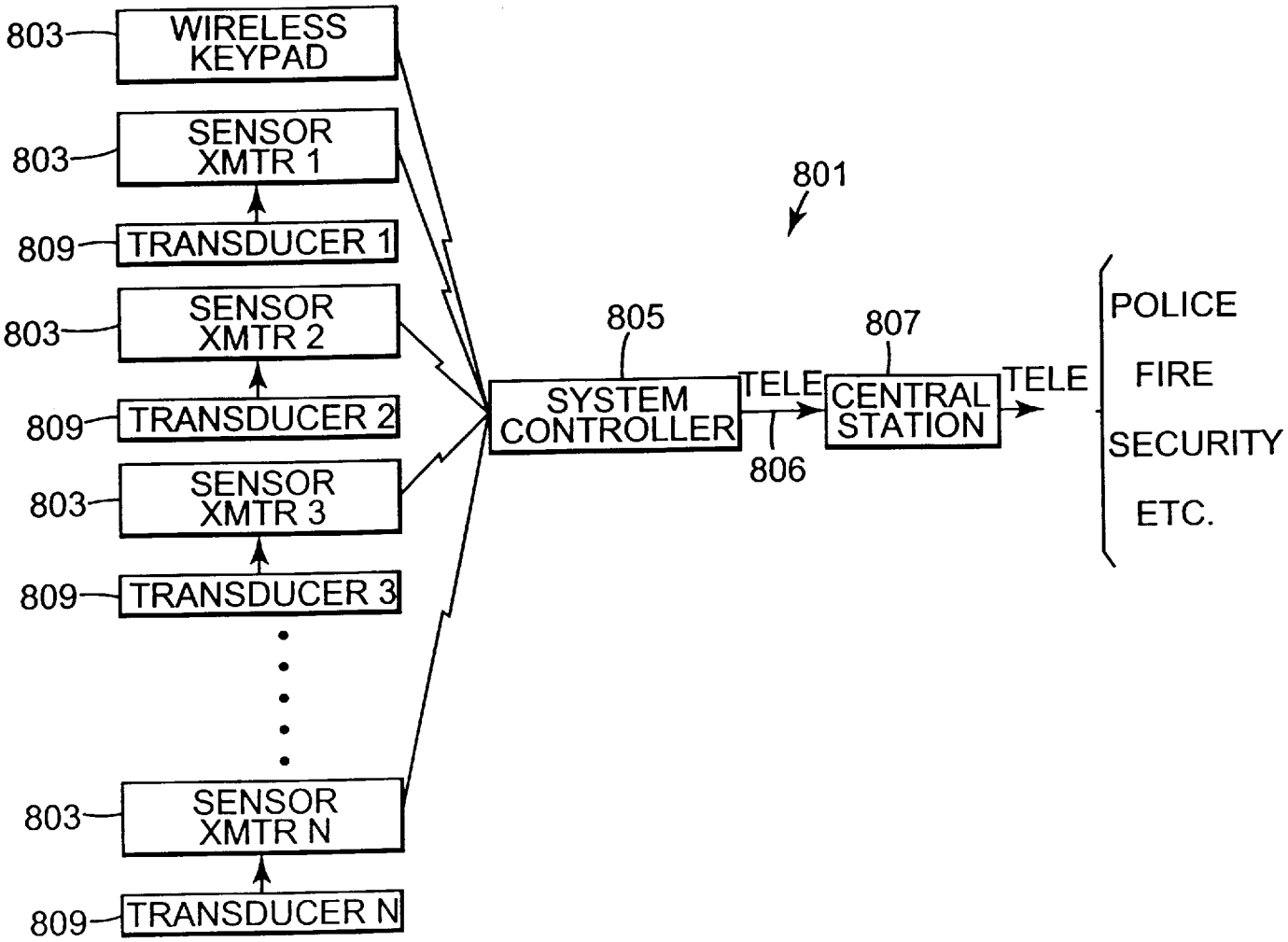
FIG. 11 is a block diagram of a message packet transmission system.

As shown in FIG. 11, security system 801 includes a plurality of remote sensors 803 that communicate with a system controller 805. The system controller 805 has a communication link 806 with a central monitoring station 807. The monitoring station 807 interprets the information received by the system controller 805 and generates the appropriate response, e.g., notifying police or fire department. Typically, remote sensors 803 have an energy supply separate from the energy for system controller 805. Therefore, system controller 805 has no information on whether the remote sensors 803 have an adequate energy supply.

In the present invention, a method and apparatus are provided for measuring the energy level, or other critical parameter, and determining whether that energy level has reached a critical value. If the critical value is detected, that information is sent to the system controller 805 at a time when the system controller 805 is most likely to receive the information.

For example, in a security system having wireless sensors that are battery-powered, the battery value is an extremely important parameter. Typically, the remote sensors use less energy when the sensor is inactive. Once the sensor 803 is activated, the sensor requires energy to generate a message to send to the system controller 805. The sensor 803 may send a series of redundant message packets to ensure that the system controller 805 receives at least one of the message packets.

Generating and sending the message packets creates the greatest drain on the sensor battery. Typically, the battery level is at its highest when sending the first message packet and at its lowest when sending the last message packet. Therefore, it is advantageous to measure the battery level toward the end of the transmission, e.g., at the last message packet.

Once the battery or other parameter is measured and a critical value is detected, that value needs to be communicated to the system controller 805 at a time when the system controller 805 is most likely to successfully receive the message. As discussed above, the sensor measures the battery level at the end of the transmission. If this information were included in the last packet, that information might not be received by the system controller 805 since the battery level is low. Therefore, the battery information is retained and sent with a next group of message packets when the battery has recovered.

Figure 1:
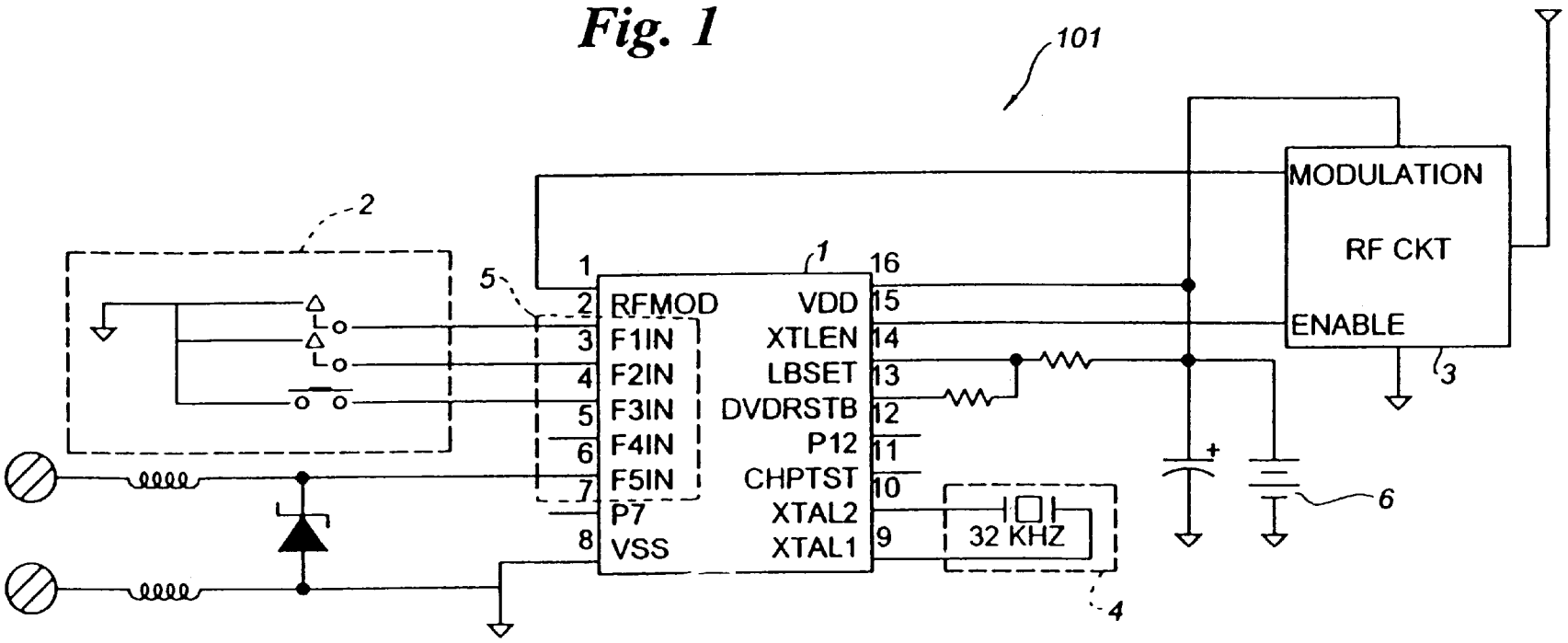
FIG. 1 is a block diagram of a wireless sensor system.

An embodiment of transmitter 803 is provided in FIG. 1. A wireless sensor system 101 includes a single-chip transmitter 1 to which sensors, e.g., a door sensor 2 (e.g., model no. 60-362 available from Interactive Technologies Inc., North St. Paul, Minn.) may be connected. When the door opens or closes, the change in condition is detected at sensor inputs 5. Transmitter 1 responds to the change by generating a message, in packets, and sending them wirelessly via an RF modulation circuit 3 to a distant system controller (not shown). The system controller decodes the message, and determines whether to send an alarm to a monitoring station (also not shown). Transmitter 1 is clocked by a 32 kHz crystal 4. The system is powered by battery 6. Other kinds of sensors can be served, including window sensors, motion detectors, sound detectors, heat detectors, and smoke detectors.

Figure 2:
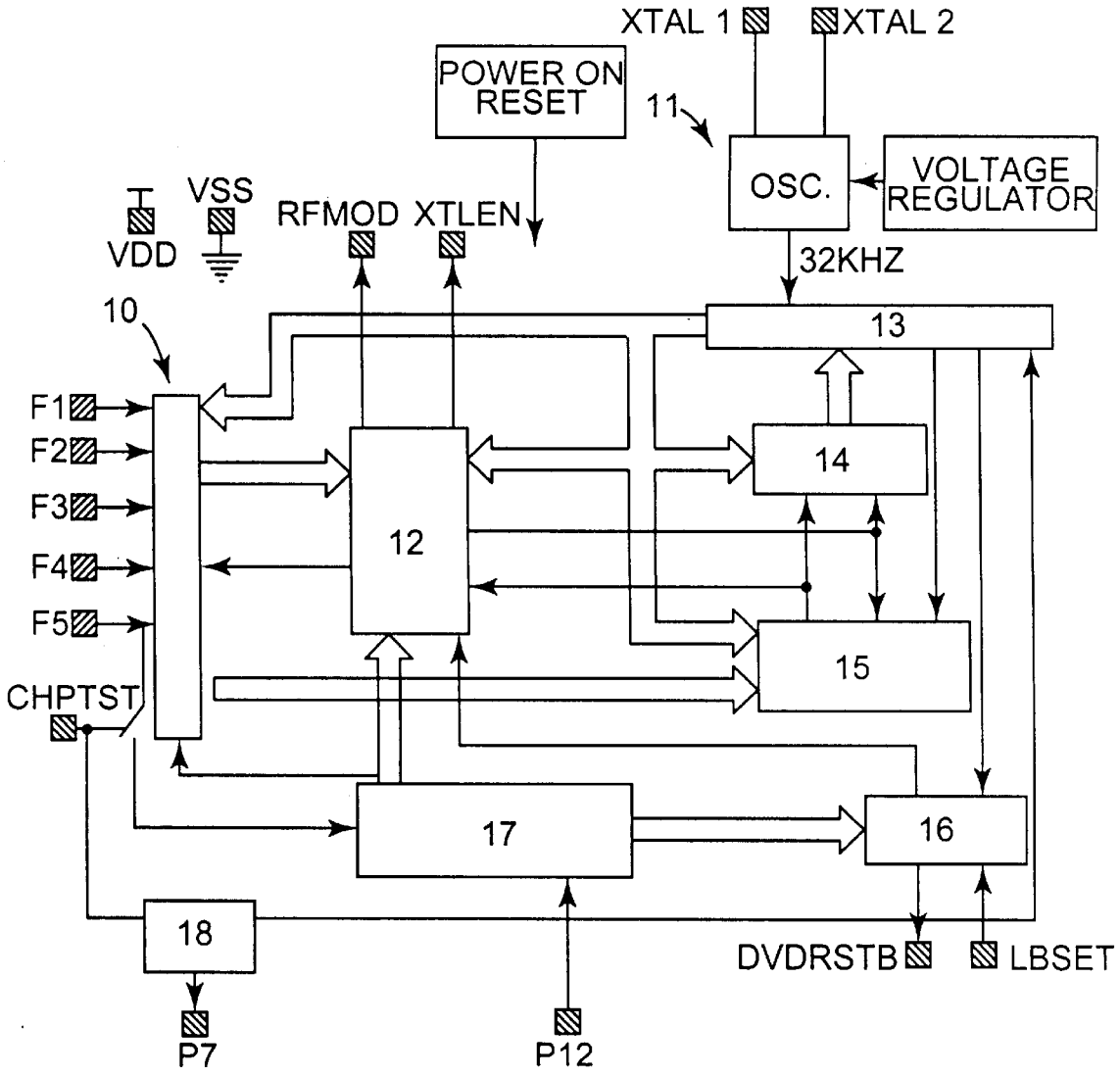
FIG. 2 is a block diagram of the single-chip transmitter of FIG. 1.

As shown in FIG. 2, the main functional components of transmitter 1 include: (1) sensor input processors 10; (2) transmission logic 12, which generates packets based on sensor inputs; (3) main timer 13, which receives clock ticks from a low power oscillator 11 and generates corresponding timing signals based on the external 32 kHz crystal 4; (4) interval timer 14 for generating pseudo-random intervals between successive packets; (5) packet counter 15 for counting the number of packets sent during a transmission; (6) battery tester 16 for testing the supply battery voltage; (7) EEPROM 17 for storing data and program information; and (8) test logic 18 for internal testing of the transmitter.

The five sensor inputs 5 appear at pins F1IN through F5IN of the transmitter 1. Each input 5 has an associated input processor 10. Input processors 10 are scanned simultaneously every 250 ms. Uninterrupted simultaneous sensing of all inputs would be impractical for a battery-powered sensor system in which the battery is expected to last for a relatively long period, e.g., five years or more.

A change in an input signal level (reflecting a change in the sensor condition) is disregarded unless it appears in two successive scan cycles. Therefore, an input signal change must be present for at least 250 ms to be accepted. Optionally, the scanning cycle may be reduced to 31 ms. The shorter scanning cycle is used in applications where a 250 ms scan is inconvenient for the system user, e.g., when a key fob is used to active/deactive a system.

Among the other pins of transmitter 1 is RFMOD which provides an output message to RF modulation circuit 3. Pin P7 provides an output of a low battery comparator associated with battery tester 16 when pin CHPTST is set to logic "1". VSS and VDD receive negative and positive supply voltage, respectively. XTLEN carries an enable signal to RF modulation circuit 3. LBSET carries a low battery threshold voltage input. DVDRSTB delivers a strobe divider output. Pin P12 receives an EEPROM programming shift clock. CHPTST receives a chip test input signal. XTAL1 and XTAL2 are connected to 32 kilohertz (kHz) crystal 4.

Input scanner 11 receives several clock signals from main timer 13, including DCLKL, KCLK, NCLK, and BCLK. Input scanner 11 also receives signal FSCAN which corresponds to bit EP31 in EEPROM 17. FSCAN controls the scan cycle; when FSCAN is a logic "0" the scan cycle is 250 ms, and when FSCAN is a logic "1" the scan cycle is 31 ms.

Figure 3A:
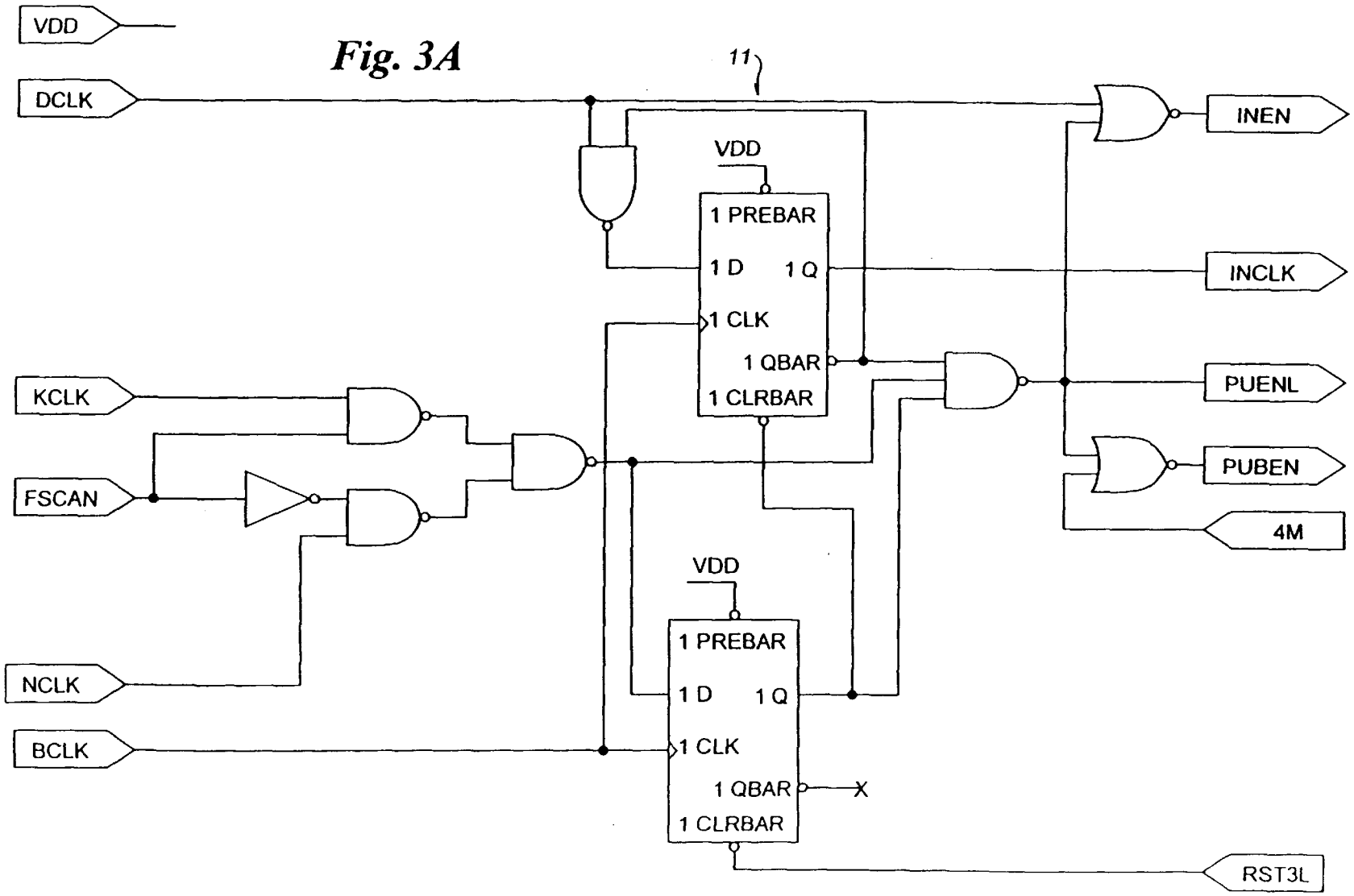
FIG. 3A is a block diagram of an input scanner.
Figure 3B:
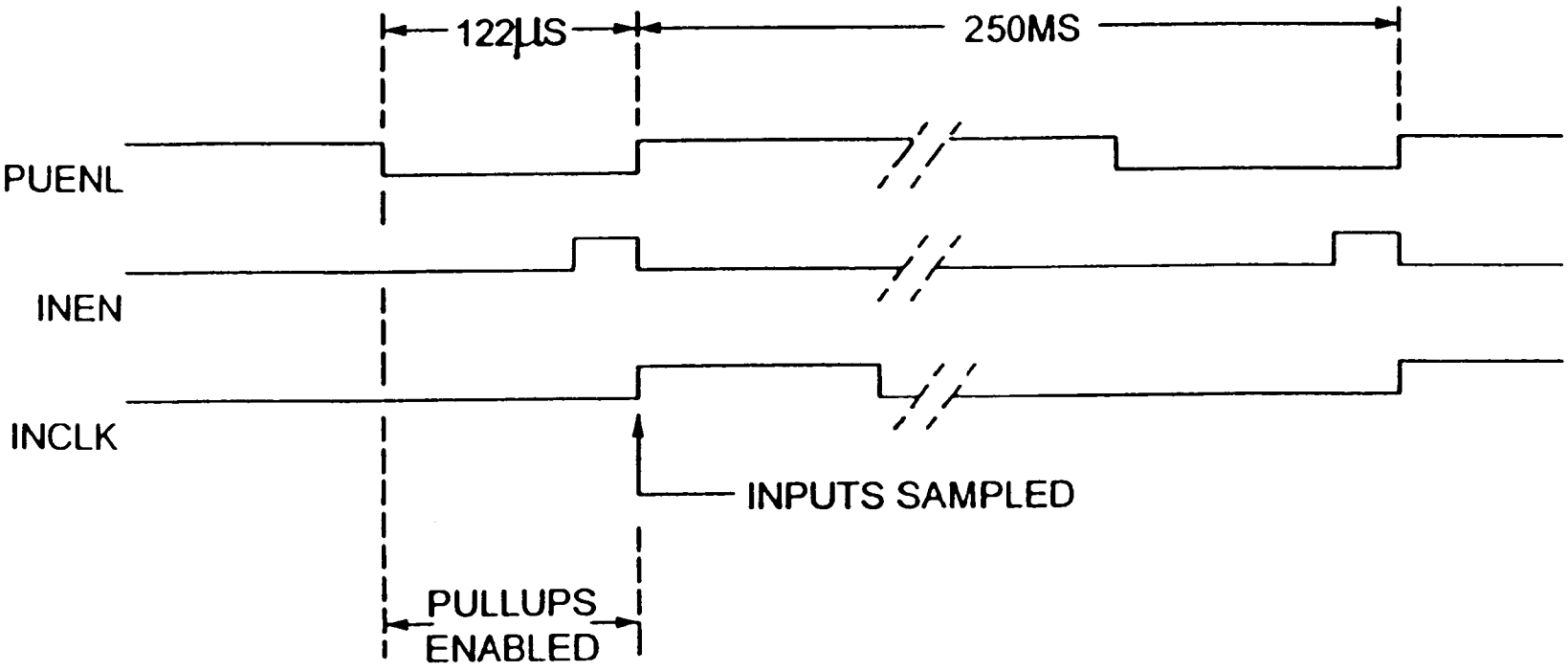
FIG. 3B is a timing diagram for the input scanner.

As shown in FIG. 3A., input scanner 11 generates four output signals, INEN, INCLK, PUENL, and PUBEN to control the detection of inputs 5 by their respective input processors 10. As shown in FIG. 3B, just before the beginning of a scanning cycle, PUENL goes low (logical 0) for about 122$\mu$s is to allow any transitional signals (caused by capacitance or noise) to settle. The beginning of the cycle is signaled when INEN goes to a logical 1. At the start of the cycle INCLK goes high and stays high while inputs are being scanned. All inputs are scanned simultaneously.

Figures 1, 4A:
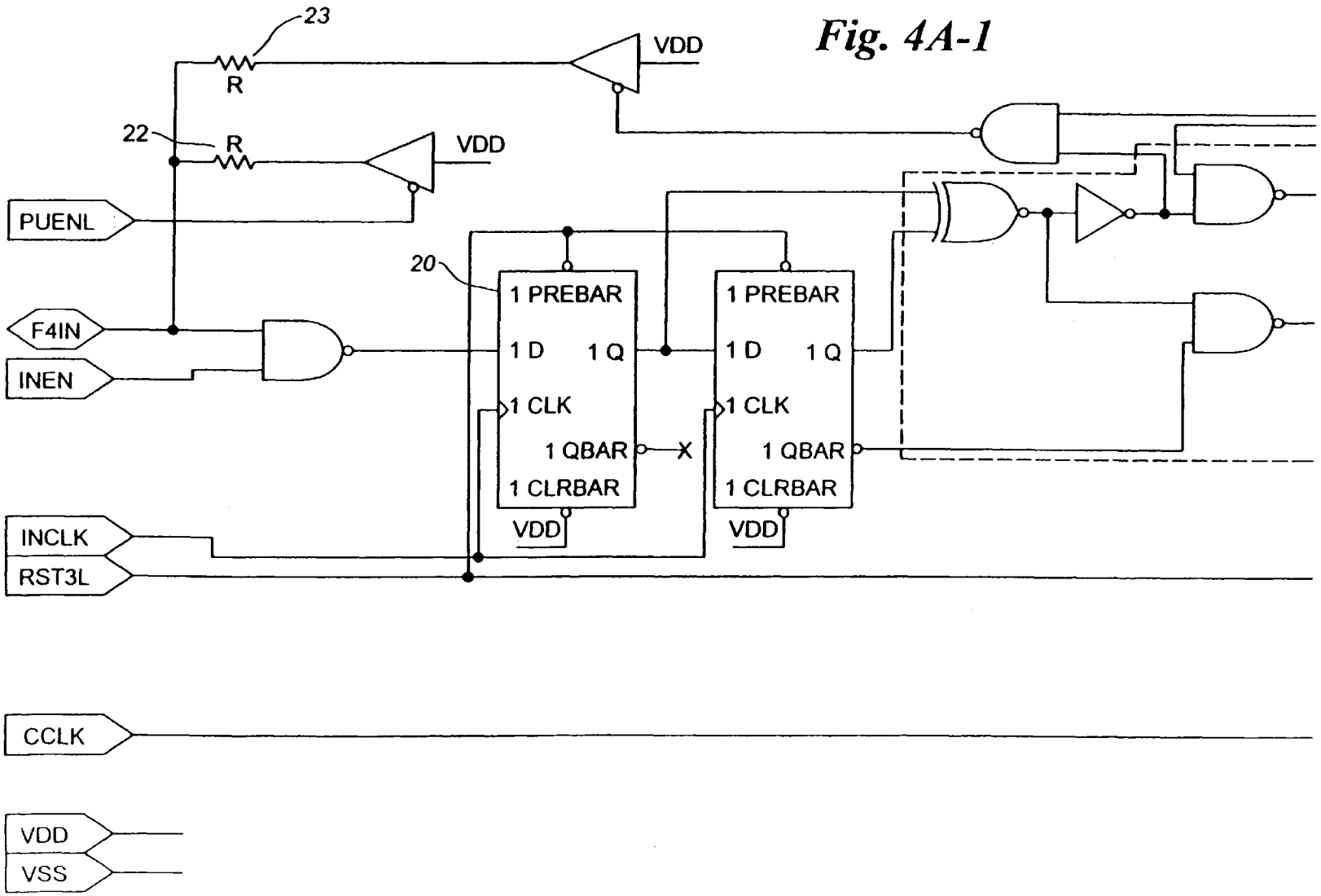
FIGS. 4A through 4D are block diagrams of input processing circuits for four inputs of the transmitter.
Figures 2, 4A:
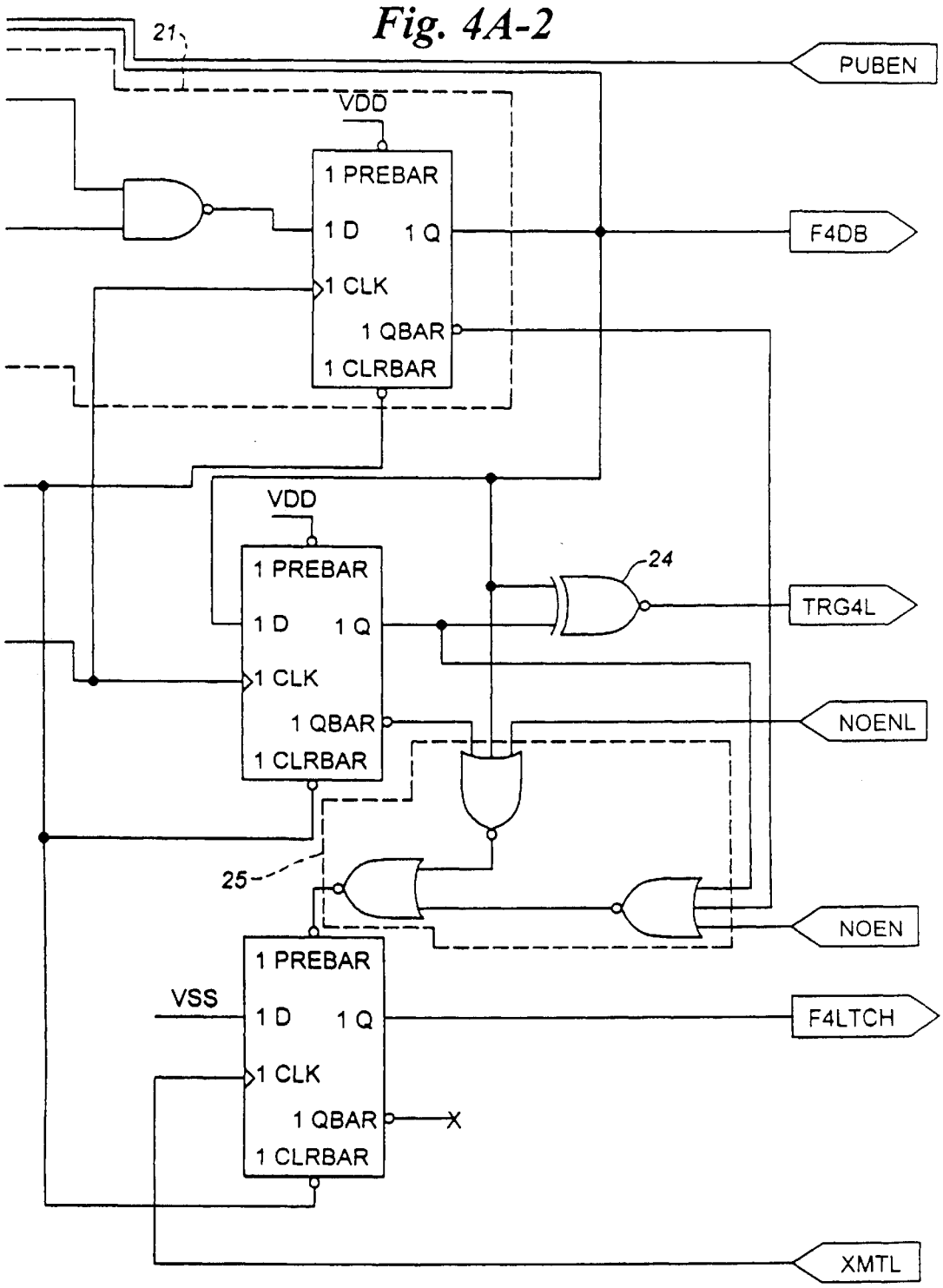

As shown in FIG. 4A, INEN is gated with sensor input signal F4IN. On the rising edge of INCLK, the gated F4IN signal is latched into flip-flop 20. The latched input signal is then processed by debounce circuitry 21 to yield debounced signal F4DB as an output.

Figures 1, 4B:
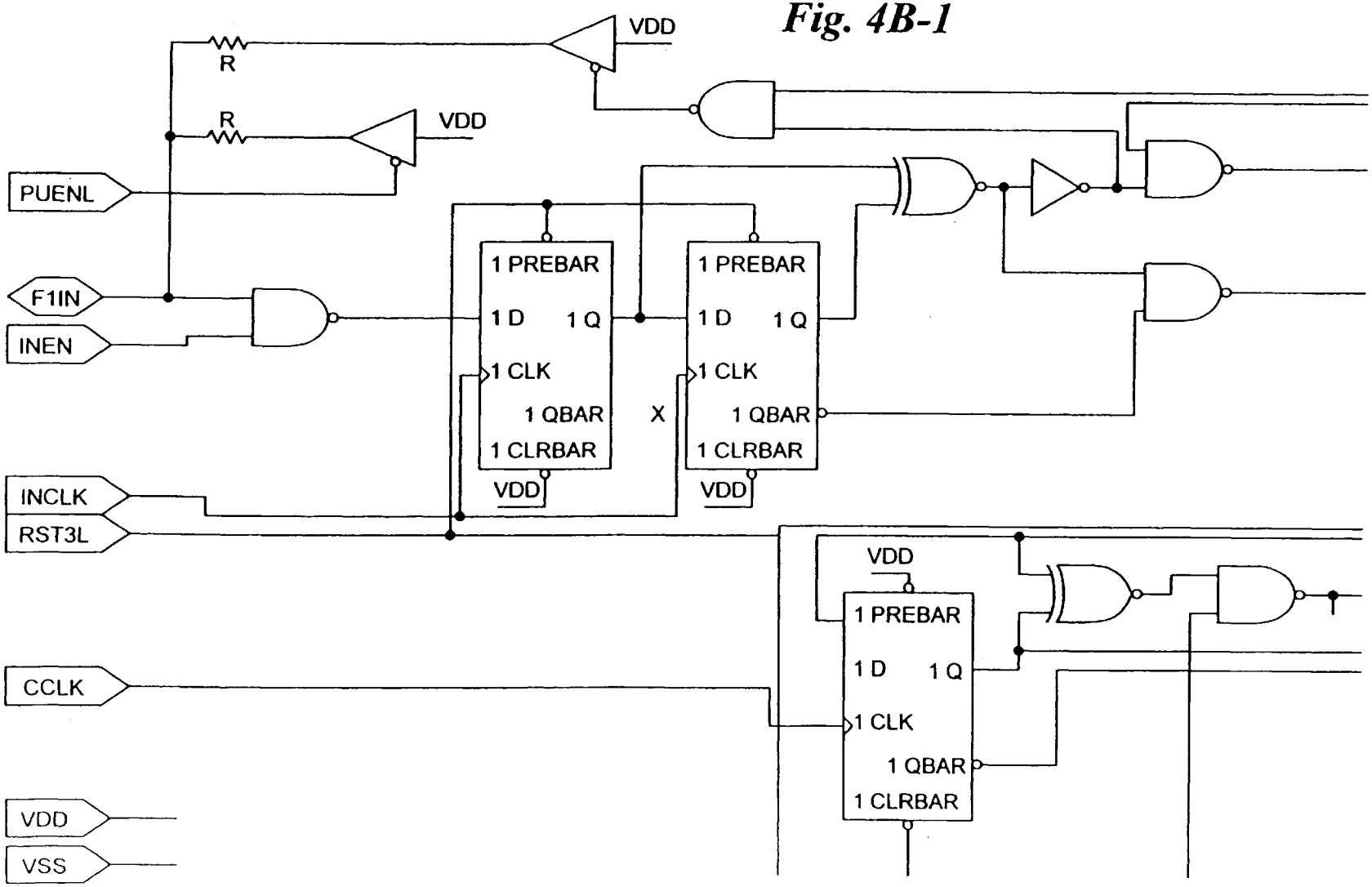
Figures 2, 4B:
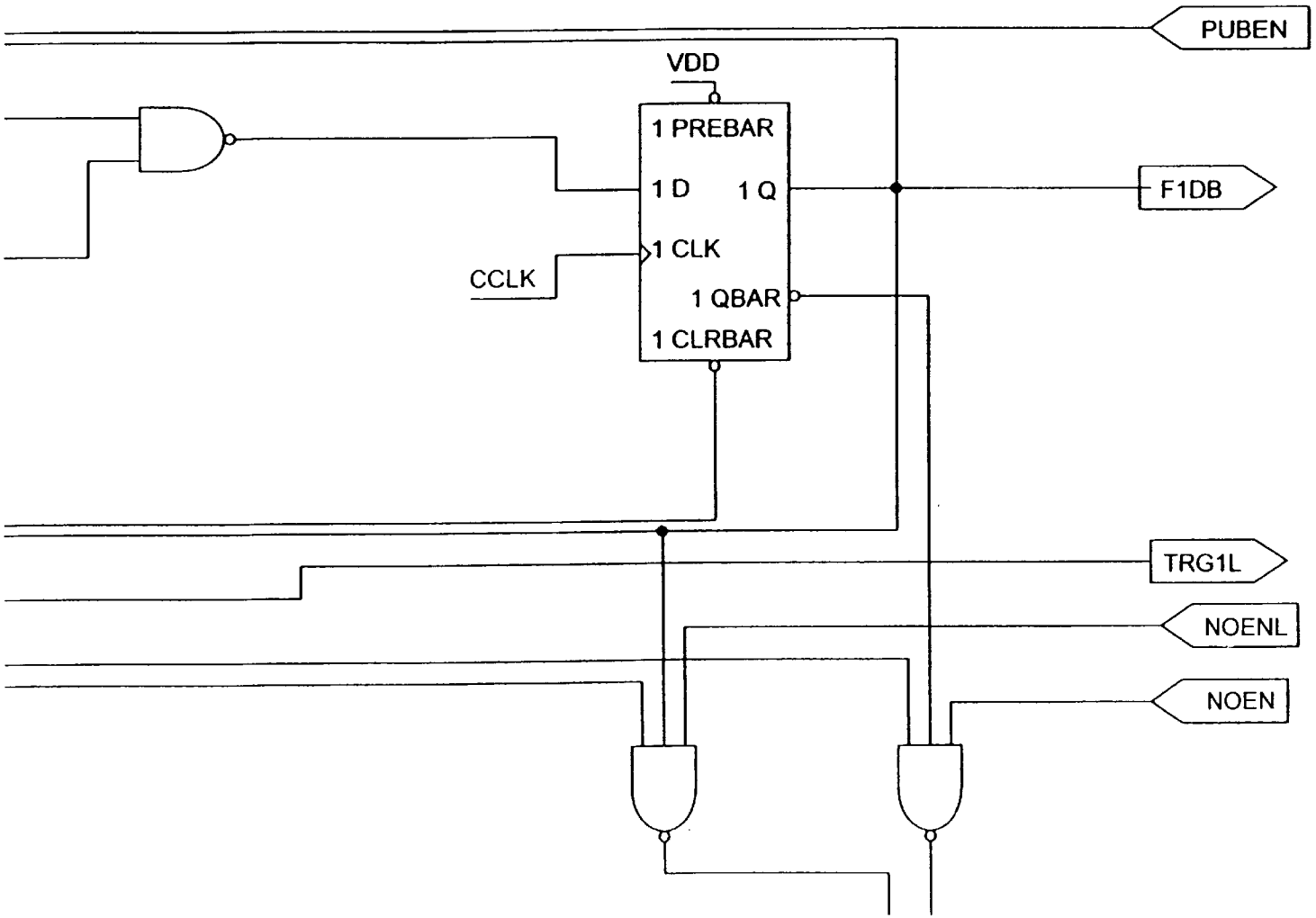
Figures 3, 4B:
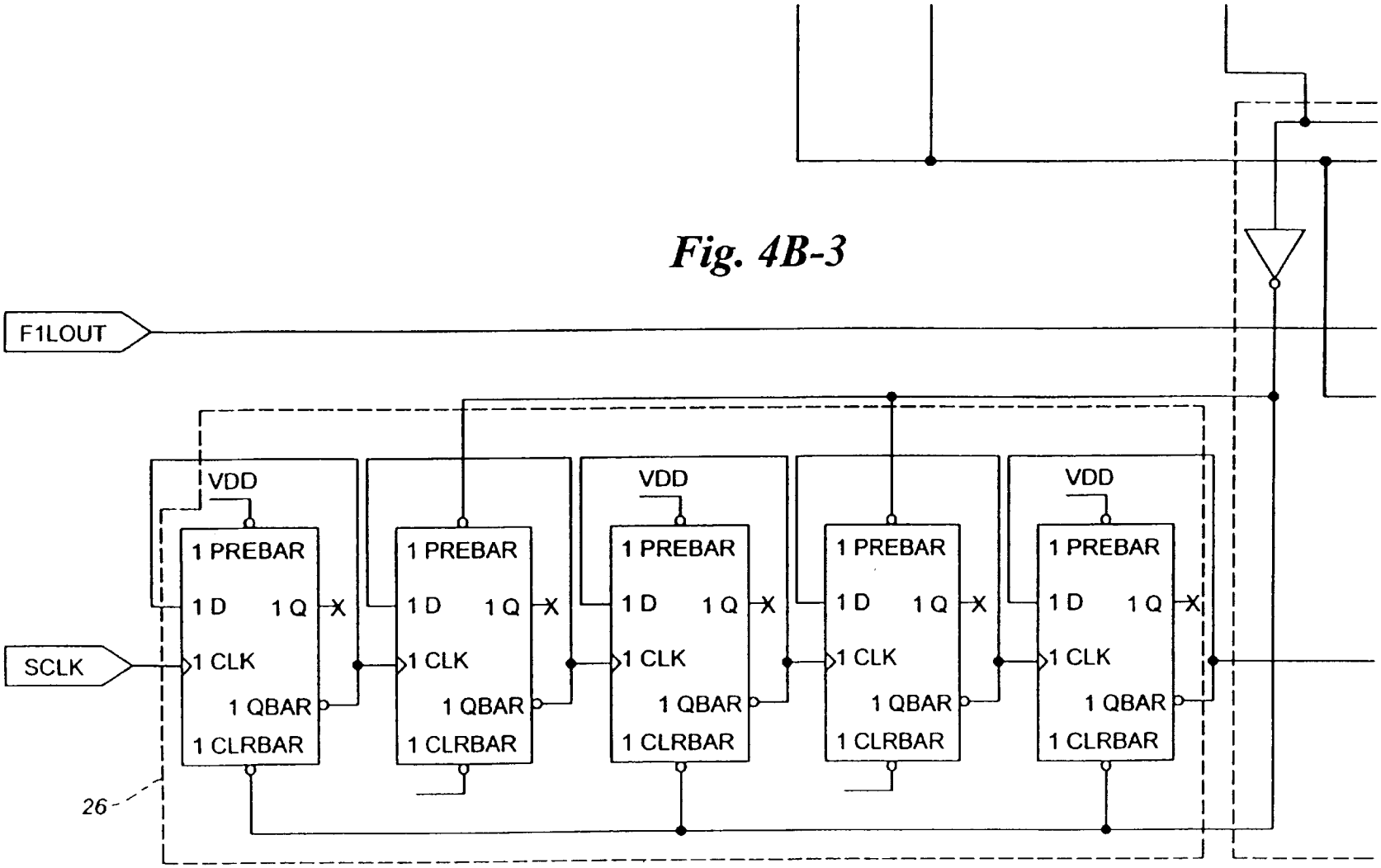
Figures 1, 4C:
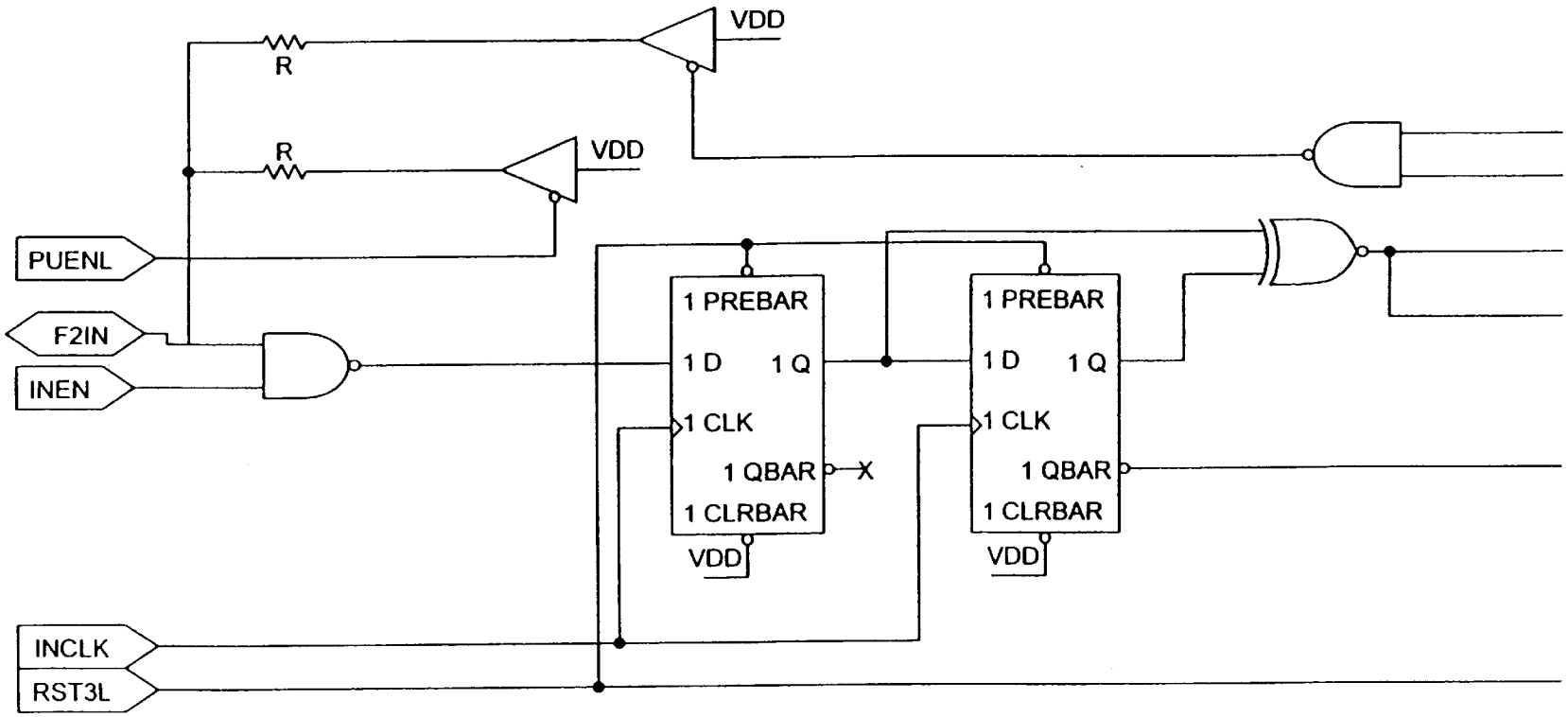
Figures 2, 4C:
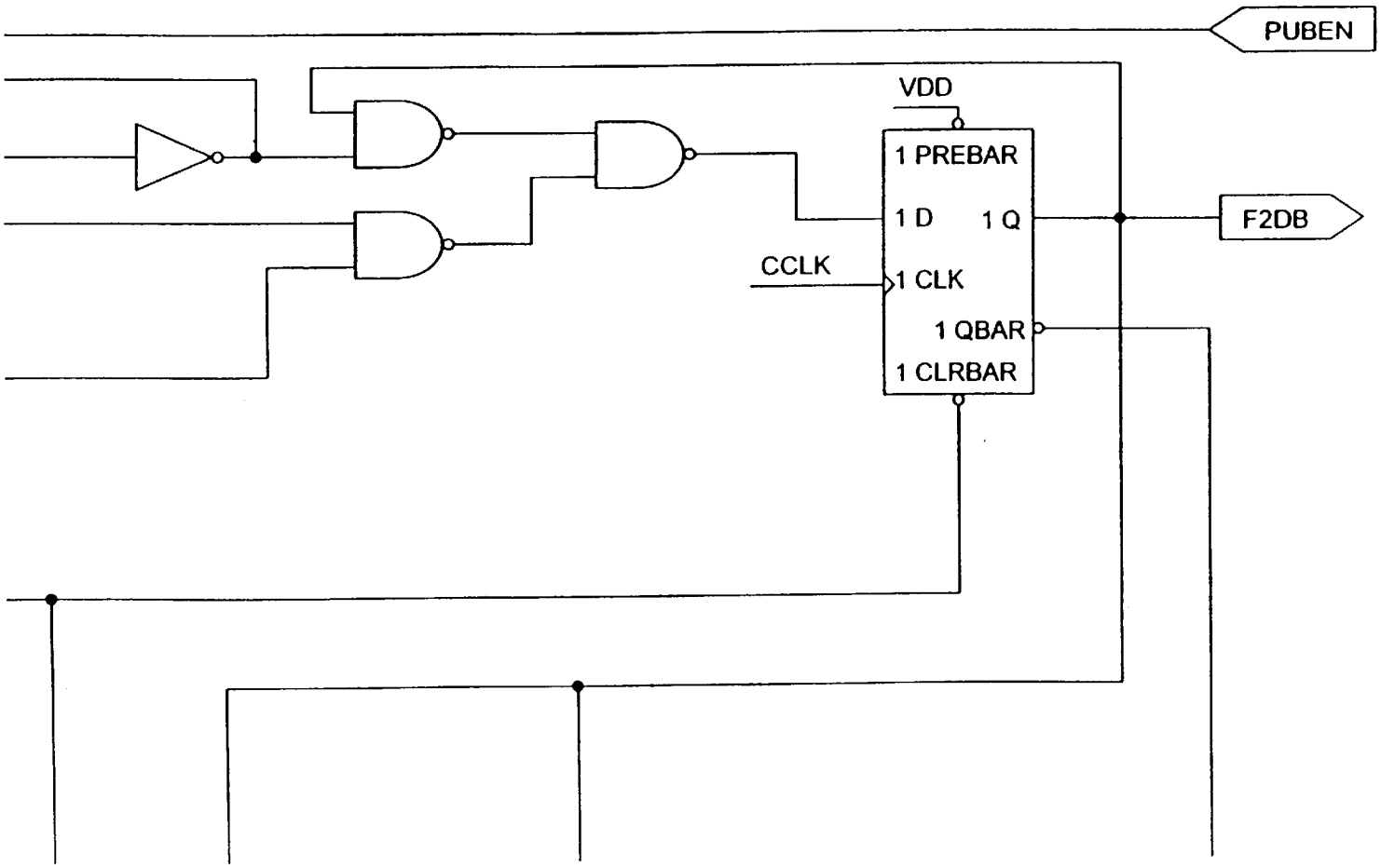
Figures 3, 4C:
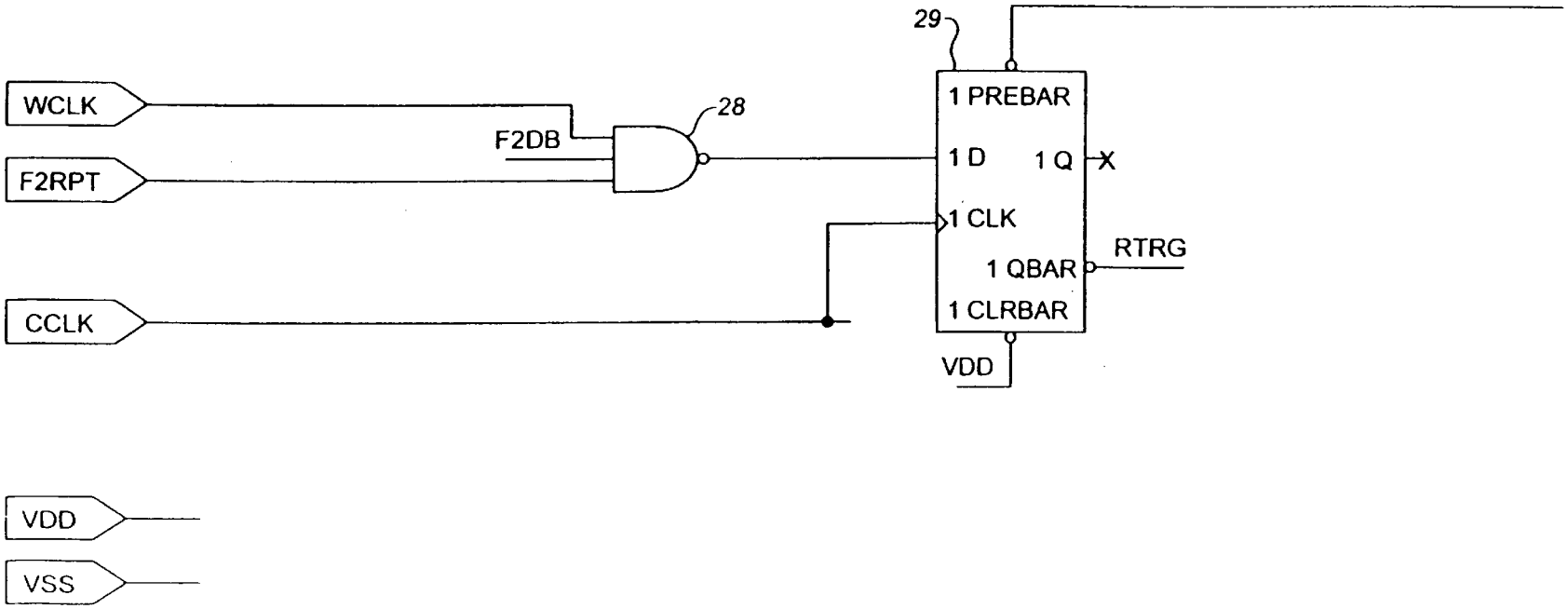
Figures 4, 4C:
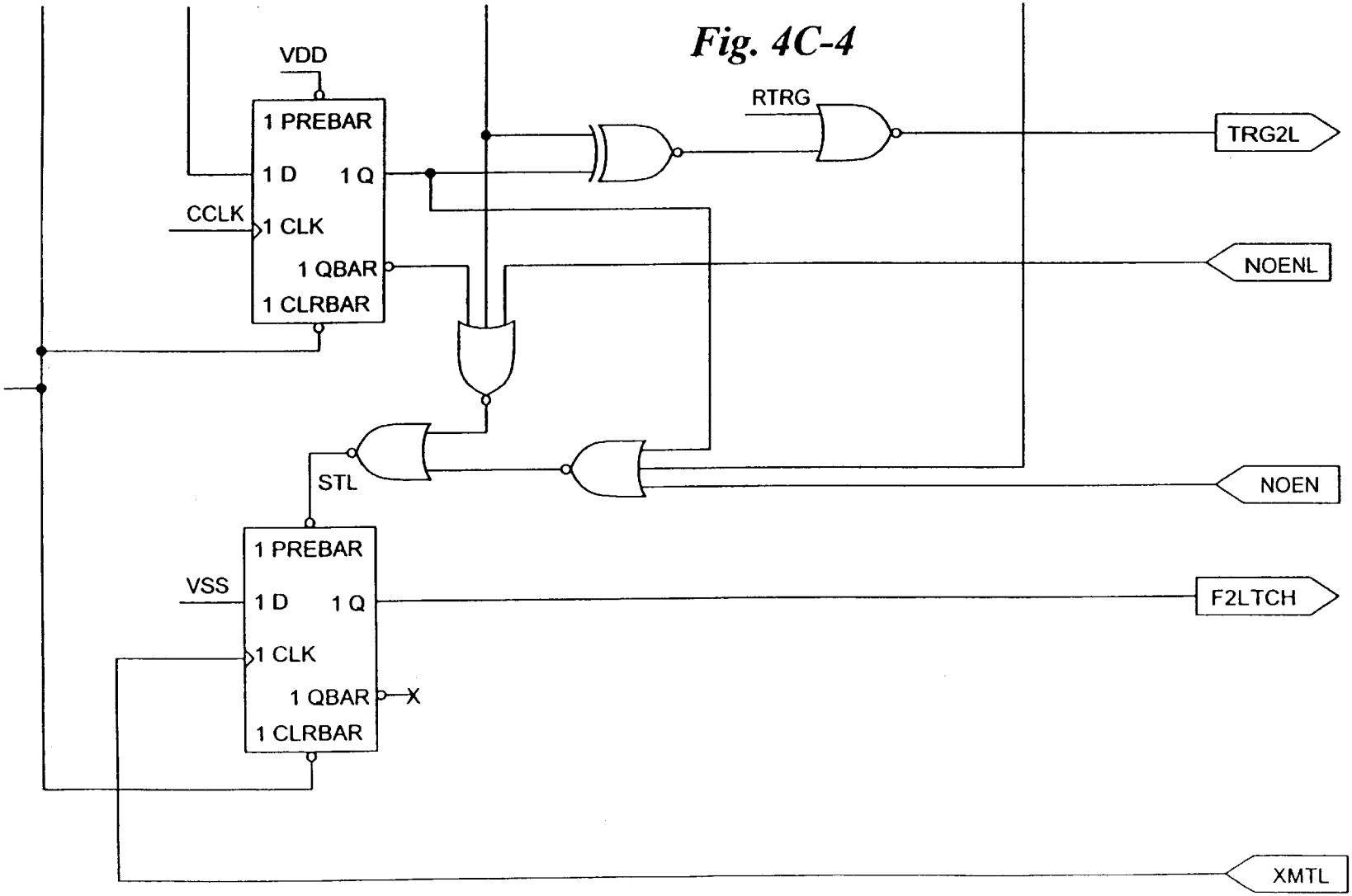
Figures 1, 4D:
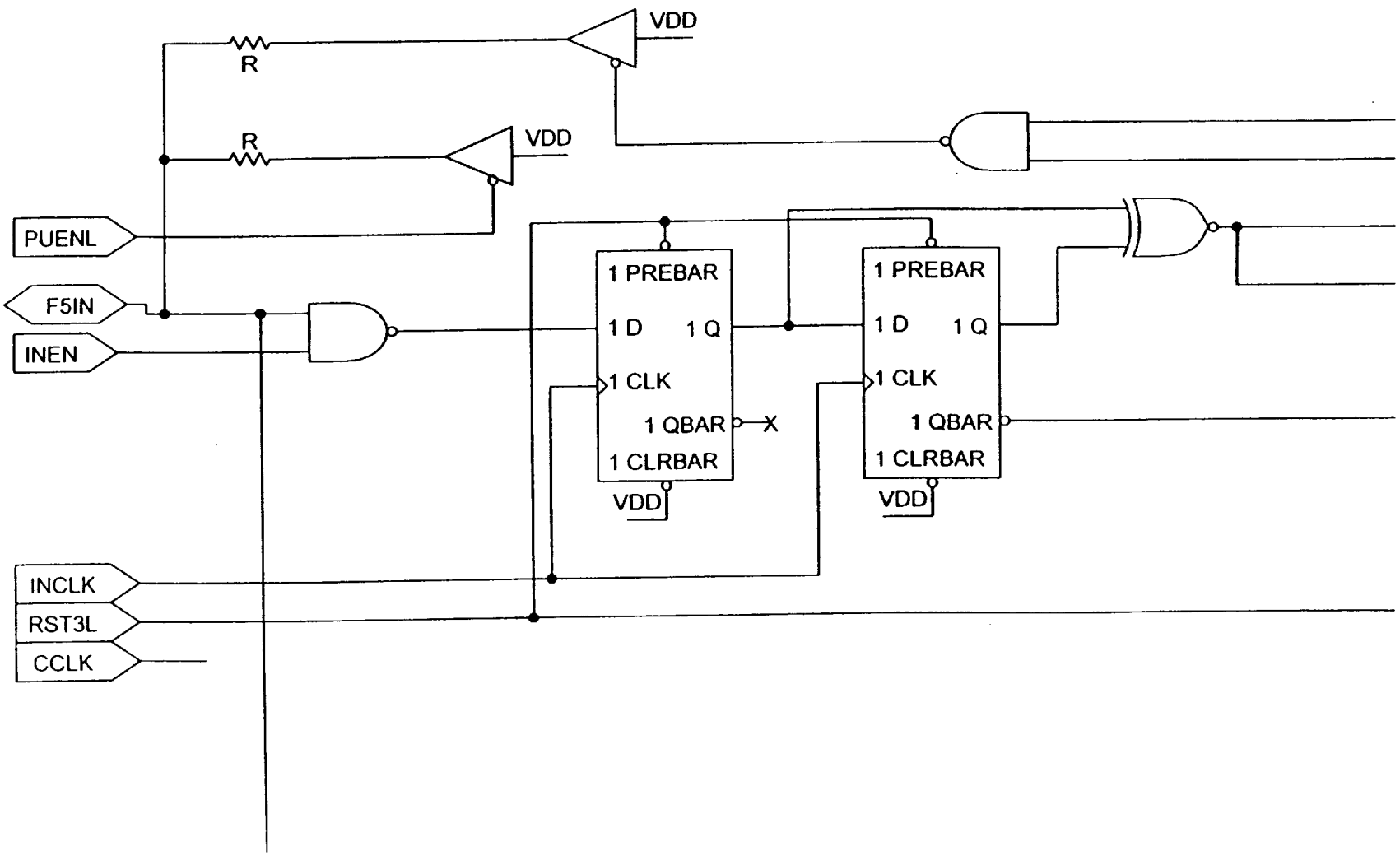
Figures 2, 4D:
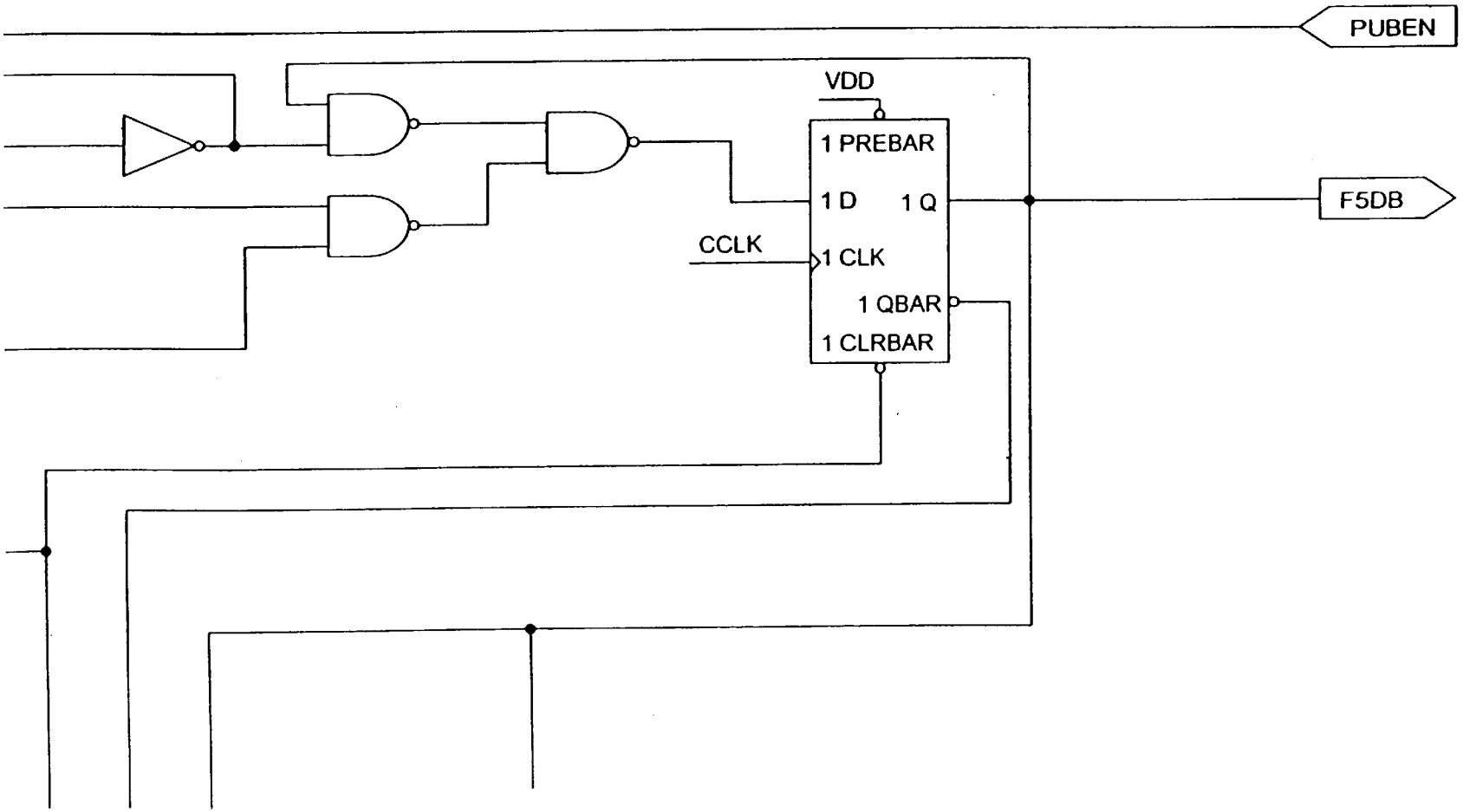
Figures 3, 4D:
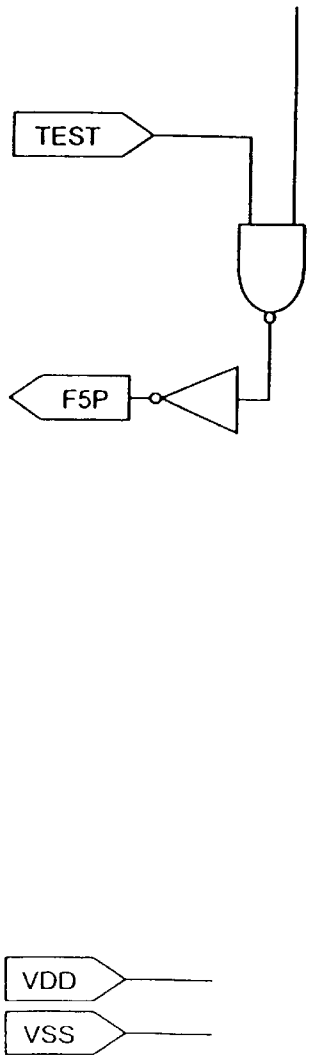
Figures 4, 4D:
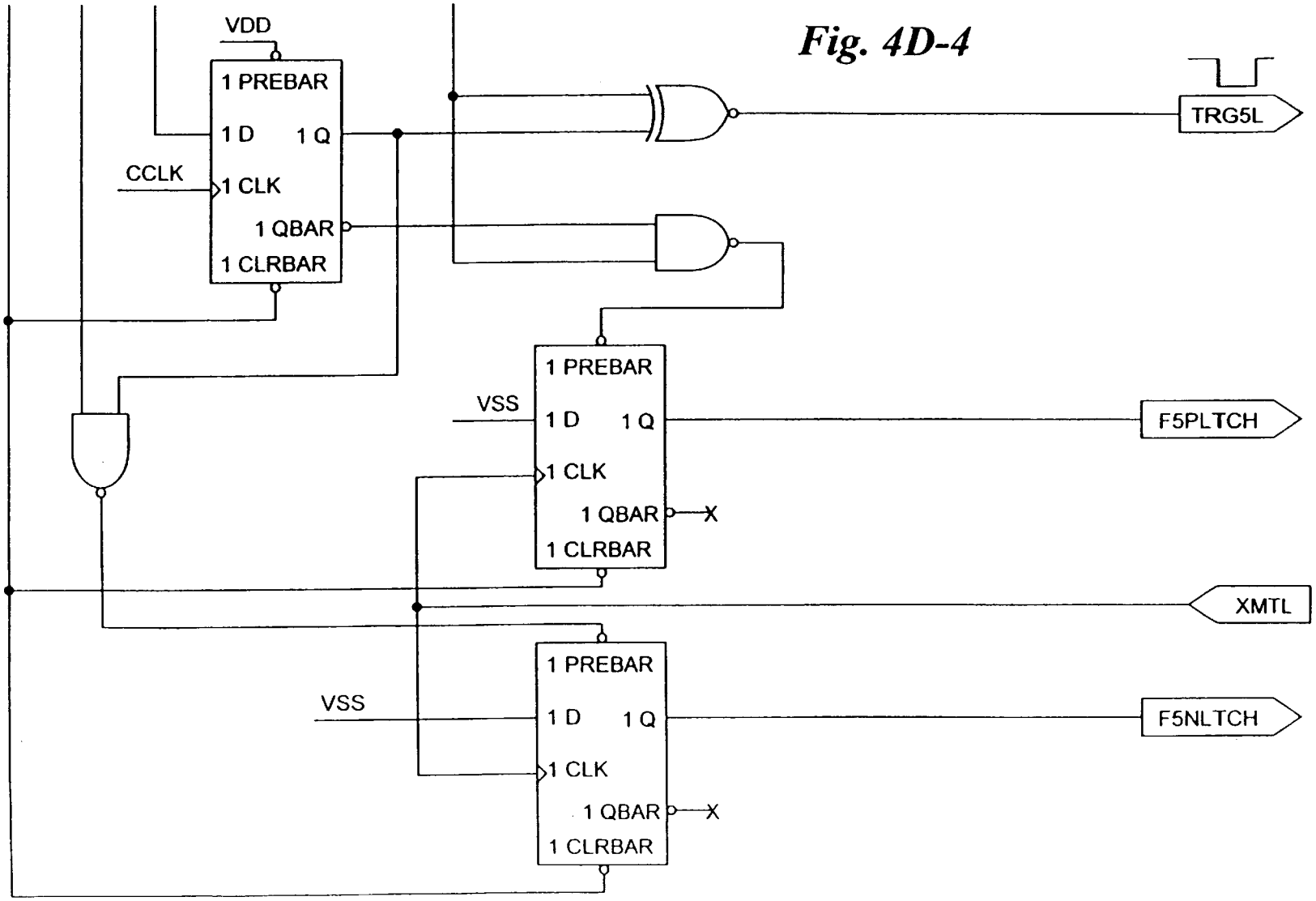

The input processors 10 for input signals F1IN, F2IN, and F5IN are shown in FIGS. 4B through 4D; the input processor for input signal F3IN is the same as in FIG. 4A. FIGS. 4B through 4D show additional processing circuitry that is specific to the associated input pins. In alternative implementations, the input processor for any given pin could have selected features from any of the FIGS. 4A–4D.

During scanning, the input pin is connected via a pull-up resistance to a voltage source VDD. As seen in FIG. 4A, this is accomplished by signal PUENL which switches in a relatively large (roughly 24 k ohm) pull-up resistance 22 (a resistor or a transistor); the larger resistance value causes a small current, thereby reducing battery drain. To reduce dendrite build-up, each input processor 10 includes a second smaller pull-up resistor 23 (roughly 5 k ohm). The larger current resulting from smaller pull-up resistor 23 reduces or blows away dendrite short circuits that may be forming on the traces of the circuit board connected with the input pins.

The development of parasitic parallel resistances, such as dendrite build-up on the circuit board, may cause an input processor 10 to initiate the generation of message packets indicating a change in condition, when no such change has actually occurred. For example, a door sensor 2 indicates whether the door is open (seen at the input pin as a logical 1) or closed (seen at the input pin as a logical 0). When the door is open, different voltage potentials exist between the copper traces on the circuit board. Dendrite particles on the circuit board are attracted to the voltage differential and can form a short circuit from trace to trace.

The short circuit causes a logical 0 to appear at the input pin. To the input processor 10, this looks the same as if the door sensor 2 has gone from an open-to-closed condition. Transmitter 1 will then send a message containing incorrect information. Once the dendrite-induced short circuit is established, it is possible that the door may be opened and closed numerous times without the transmitter 1 generating and sending packets which reflect the actual changes in condition.

Dendrite short-circuits and other types of parasitic parallel resistance are eliminated or overcome by using two pull-up resistors 22, 23. The first pull-up resistor 22 is normally used to switch in the power supply when the input processors 10 are scanned. The resistance value of pull-up resistor 22 is selected to activate the circuit with a low current, thereby conserving the battery. However, the current generated by pull-up resistor is not sufficient to destroy or overcome a dendrite-induced short circuit. Therefore, if a change of condition is detected, e.g., the signal at the input pin goes from logical 1 to logical zero, a second pull-up resistor 23 is used to switch in the battery. The resistance value of pull-up resistor 23 is selected to generate a current sufficient to destroy or overcome dendrite-induced short circuits. This two-resistor scheme eliminates or reduces false information from being generated by transmitter 1 (by selectively using a high current) without significantly increasing the energy requirements (by normally using a low current).

As discussed above, each input processor 10 is scanned about once every 250 msec. In addition to reducing the energy requirements of the transmitter, scanning helps reduce dendrite build-up in two ways. First, periodic scanning as opposed to a constant scan greatly reduces the time period when voltage differentials exist, thereby reducing the conditions under which dendrite short circuits form. Second, periodic scanning allows for larger currents on each scan. The larger currents are more likely to destroy dendrite build-up.

During scanning, the input pin is connected via a pull-up resistor to a voltage source VDD. As seen in FIG. 4A, this is accomplished by signal PUENL, which switches in either a relatively large (roughly 24 k ohm) pull-up resistor 22 (a resistor or a transistor), or a relatively smaller, second pull-up resistor 23 (roughly 5 k ohm). During periods when no change in condition occurs, relatively large pull-up resistor 22 is used to switch in voltage source VDD. The larger resistance value creates a smaller current, reducing the drain on the transmitter battery 6. This smaller current may have little or no effect on short circuits created by dendrite build-up.

If a change of condition is detected between scan cycles (e.g., logical 1 to logical 0), the smaller pull-up resistor 23 is used to switch in voltage source VDD on the next scan cycle. The smaller pull-up resistor 23 creates a larger current sufficient to destroy or overcome dendrite short circuits. In another embodiment, the small pull-up resistor 23 is used to switch in VDD immediately upon a change in condition.

If dendrite build-up has created a short circuit, the input processor will detect a change of condition from open to closed (logical 1 to logical 0). On the next scan cycle, smaller pull-up resistor 23 is connected with voltage source VDD and the larger current destroys the short circuit. The input processor will now detect a change in condition from closed to open (logical 0 to logical 1). Therefore, input processor 10 will not generate a TRGxL signal (discussed below) and the transmitter 1 will not generate message packets indicating a change in condition because a change in condition has not been detected for two consecutive scan cycles.

As discussed above, in another embodiment, the small pull-up resistor 23 is used to switch in VDD immediately upon a change in condition, as opposed to waiting for the next scan cycle. Therefore, at the end of the scan, after smaller pull-up resistor 23 is used to destroy the dendrite short circuit, the condition detected by input processor 10 will be the same as the previously detected condition.

The smaller pull-up resistor 23 is not used on every scan cycle because it will drain the battery more rapidly than resistor 22. As discussed above, it is important to maximize the life of battery 6 associated with wireless transmitter 1. Therefore, in the present invention, the smaller resistor 23 is only switched into the circuit when a change in condition has first been detected by a larger resistor, e.g., resistor 22. Limiting the use of smaller resistor 23 extends the battery life while at the same time preventing or reducing incorrect information being sent to the system controller due to dendrite-induced short circuits.

As an example, one can compare three ways to energize input processor 10. First, a non-pulsed, single pull-up resistor can be used. Second, a pulsed, single pull-up resistor can be used. Finally, the pulsed, 2-stage resistance of the present invention can be used. In the first case, the pull-up current (I) must be minimized to maintain a suitably long battery life, e.g., $1\mu$ amp, limiting the battery draw $1\mu$ amp. The parasitic parallel resistance at failure (0.5 V/I) is about 1.8 MΩ. Therefore, this circuit is very sensitive to parasitic parallel resistance.

In the second case, using the scanning sequence disclosed above, a larger pull-up current I, e.g., $150\mu$ amps, can be used, while decreasing the battery draw (due to scanning) to $0.075\mu$ amps. The parasitic parallel resistance at failure is now about 12 KΩ.

In the third case, i.e., the present invention, the second pull-up resistor generates a larger current, e.g., $750\mu$ amps. The normal battery draw is still about $0.075\mu$ amps. However, when the second resistor is used, the parasitic parallel resistance at failure is now about 2.4 KΩ. Therefore, a circuit that implements the two resistor scheme is much less susceptible to parasitic parallel resistance.

In one embodiment, pull-up resistor 23 is used following any detection of a change in condition, i.e., open-to-closed or closed-to-open. In another embodiment, pull-up resistor 23 is used only when the change in condition is open-to-closed.

An additional feature to balance the requirements of battery conservation and dendrite reduction is the use of a lockout period. Once the smaller pull-up resistor 23 is used in a scanning cycle, pull-up resistor 23 is not used for a predetermined time period. The time period is selected to balance battery conservation with the likelihood of dendrite build-up. In one embodiment, the lockout period is about 4.25 minutes.

The lockout feature is implemented as shown in FIG. 3A by generating signal PUBEN, enabled by signal 4M from packet counter 15.

The selective use of pull-up resistors can be used to overcome other types of short circuits in addition to dendrite-induced short circuits. There are various situations where a short circuit can unexpectedly develop between parallel resistors. In many of these instances it would be advantageous to switch in a higher current that can eliminate or overcome a short circuit once a possible short circuit is identified by a current more suitable to normal operating conditions.

Among the other signals received by input processor 10 are CCLK, from main timer 13, which provides a 122$\mu$s clock pulse, NOEN and NOENL which both derive from bit EP27 in EEPROM 17, and determine whether the latched input signal FxLTCH is set on a low-to-high input signal transition (for sensors that are normally closed) or on a high-to-low signal transition (for sensors that are normally open). Signal XMTL is generated from packet counter 15 and resets the latched input signal FxLTCH at the end of a message transmission.

Each debounced signal FxDB is fed to gate 24, along with a timing pulse derived from CCLK, to generate signal TRGxL that triggers both transmission logic 12 and packet counter 15. Debounced input signal FxDB is also processed by gates 25 to generate latched input signal FxLTCH.

As shown in FIG. 4B, the input processor for pin F1IN includes a lock-out timer which is used with a sensor of the kind that triggers constantly during certain periods (e.g., a passive infrared motion detector). The lock-out timer reduces the volume of messages, saving the battery. The lock-out function is enabled by signal F1LOUT from EEPROM 17, bit EP24. Flip-flops 26 form a 168 second (approximately) timer using SCLK as a clock input. Lock-out circuit 27 disables signals TRG1L and F1LTCH for about 168 seconds after a TRG1L signal.

As shown in FIG. 4C, input processor 10 for input pin F2IN includes a repeater function which is useful with critical sensors such as a smoke detector. The repeater function is achieved using gate 28 and flip-flop 29. Gate 28 has as inputs WCLCK (clock ticks appearing every 64 seconds), debounced signal F2DB, and the repeater enable signal F2RPT from EEPROM 17, bit EP26. This circuit initiates signal TRG2L every 64 seconds, causing generation of another group of message packets. Thus, as long as a sensor active signal is detected, i.e., pin F2IN is high, the system controller will receive the sensor message approximately every minute and will send repeated alarm messages to the monitoring station.

As shown in FIG. 4D, input processor 10 that serves pin F5IN includes elements that latch the debounced signal F5DB on both the rising and falling edges of the signal transition F5PLTCH and F5NLTCH, respectively. This configuration provides flexibility by accepting sensors that are in a normally open or closed state.

Each message generated by transmitter logic 12 is configured as a sixty-four bit data packet. Normally a series of eight identical data packets are transmitted for each qualified input signal change to assure that the system controller will reliably receive the message notwithstanding battery drain, overloading of the system by messages coming into the system controller, and other factors. If transmitter 1 is re-triggered by a sensor signal change while a group of packets is already being transmitted, the ongoing transmission of that group of packets is completed, then eight more packets are transmitted with the newer data.

Optionally, transmitter 1 may generate a group of only four packets for each qualified signal change during periods of frequent sensor triggering as a way to reduce battery drain. After the first series of eight packets is sent, if a subsequent input change is detected within 4.25 minutes of the end of the last packet transmission, then only four packets are sent. Otherwise, eight packets are sent.

Each packet carries sensor data and identification and includes sixty-four bits:

| Bits | Description |
|---|---|
| 00–02 | 976 $\mu$s RF front porch pulse |
| 03–14 | 12 sync pulses, logical zeros |
| 15 | start pulse, logical one |
| 16–35 | 20 bit sensor identification code (ID bits 0–19) |
| 36–39 | 4 bit device type code (DT bits 0–3) |
| 40–42 | 3 bit trigger count (TC bit 0–2) |
| 43 | low battery bit |
| 44 | F1 latch bit |
| 45 | F1 debounced level |
| 46 | F2 latch bit |
| 47 | F2 debounced level |
| 48 | F3 latch bit |
| 49 | F3 debounced level |
| 50 | F4 latch bit |
| 51 | F4 debounced level |
| 52 | F5 positive latch bit |
| 53 | F5 debounced level |
| 54 | F5 negative latch bit |
| 55 | even parity over odd bits 15–55 |
| 56 | odd parity over even bits 16–56 |
| 57 | zero/one, programmable |
| 58 | RF on for 366 $\mu$s (old stop bit) |
| 59 | one |
| 60–62 | modulus 8 count of number of ones in bits 15–54 |
| 63 | zero (new stop bit) |

Figure 5A:
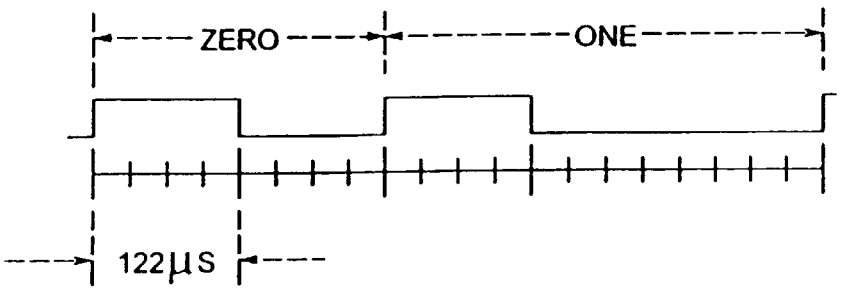
FIG. 5A is a timing diagram of bit values.
Figure 5B:
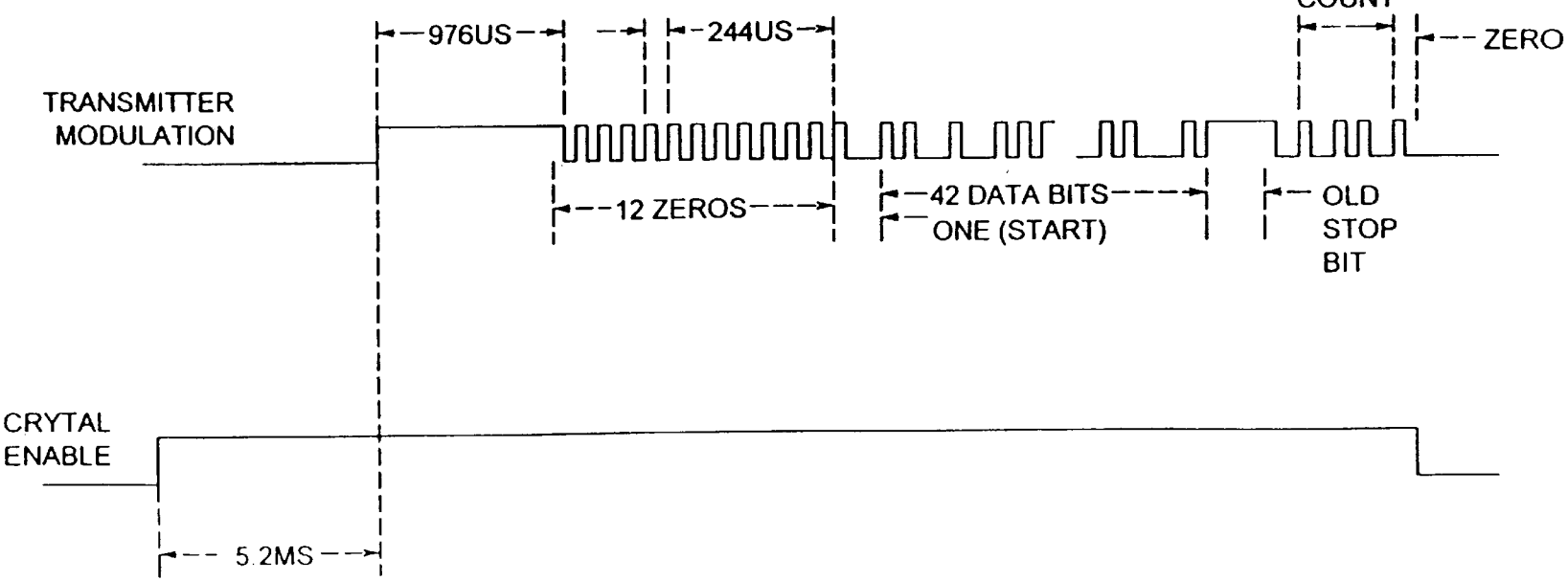
FIG. 5B is a timing chart of a packet.

As shown in FIG. 5A, transmitter 1 uses pulse-width modulation to generate logical 1's and 0's. A 1 bit has 122$\mu$s RF on and 244$\mu$s RF off, a 0 bit has only 122$\mu$s RF off. As shown in FIG. 5B, crystal enable pin, XTLEN, goes high approximately five ms before the start of each packet transmission and remains high until the end of the packet transmission.

The interval between successive packets in a group is varied pseudo-randomly from about 93 ms to 453 ms.

If about an hour elapses without a packet transmission, the main timer 13 will automatically cause transmitter 1 to send three, identical supervisory data packets each having the same configuration as for other packets. The quiet interval which ends in the supervisory packets being sent is varied in a pseudo-random manner from about 64 minutes to 68 minutes. Alternatively, the supervisory signals may be sent after a quiet period of only sixty-four seconds. The sixty-four second supervisory is used in high security applications, e.g., home incarceration.

EEPROM 17 stores 36 control bits. Bits EP00 to EP19 provide 20 sensor identification code bits. Bits EP20 to EP23 provide four device type bits (e.g., 0101 for a smoke detector). Bits EP32 to EP34 provide three band gap accuracy trim bits used with battery tester 16.

EEPROM bits EP24 to EP31 provide programming options. When EP24 is set to logical 1, it enables the three minute lock-out function as described above regarding FIG. 4B. When EP25 is set to logical 1, the supervisory interval is shifted from approximately one hour to sixty-four seconds. When EP26 is set to logical 1, the repeater function will trigger data transmissions every sixty-four seconds. When EP27 is set to logical 0, the input latch signals FxLTCH are set on the low to high input signal transition. For EP27 set to logical 1, the input latch signals FxLTCH are set on the high to low input transition.

EP28 controls the number of packets transmitted for each sensor trigger (logical 0 yields eight packets per group; logical 1 yields eight packets for more than 4.25 minutes from the end of the last packet transmission, otherwise only four packets).

When EP29 is logical 1, bits 60 to 63 of the packet are not transmitted, making the transmitter compatible with sixty bit systems. EP30 controls the value of bit 57. Bit 57 can be used as an additional bit to identify the device type. EP31 set to logical 1 increases the input scan cycle rate to 32 scans per second. When EP35 is set to logical 1, transmitter 1 delivers a 32 kHz signal on pin P7, otherwise 32 Hz.

The EEPROM is programmed by serial input. Pin CHPTST is set to logical 1. The EEPROM data is then serially entered on pin F5IN while a shift clock (PRGCLK) is delivered at pin 12. The data is shifted on the rise of each clock pulse. The serial data bits are preceded by a logical 1 followed by the program bits PB00 through PB35. Transmitter 1 begins EEPROM programming when it detects that the leading logical 1 has reached the end of the EEPROM 17 shift register.

Figures 6, 7, 8, 9, 10:
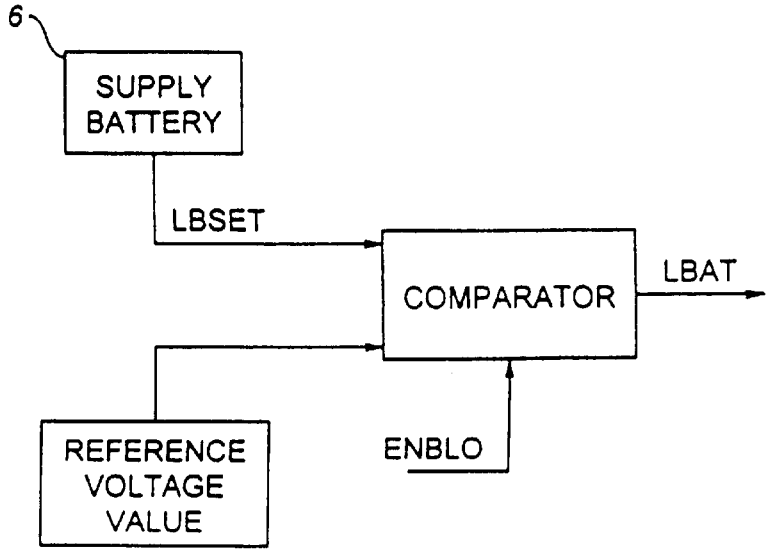
FIG. 6 is a block diagram of a main timer.
FIG. 7 is a block diagram of an interval timer.
FIG. 8 is a block diagram of a packet counter.
FIG. 9 is a block diagram of transmitter logic.
FIG. 10 is a block diagram of a battery tester.
Figure 6A:
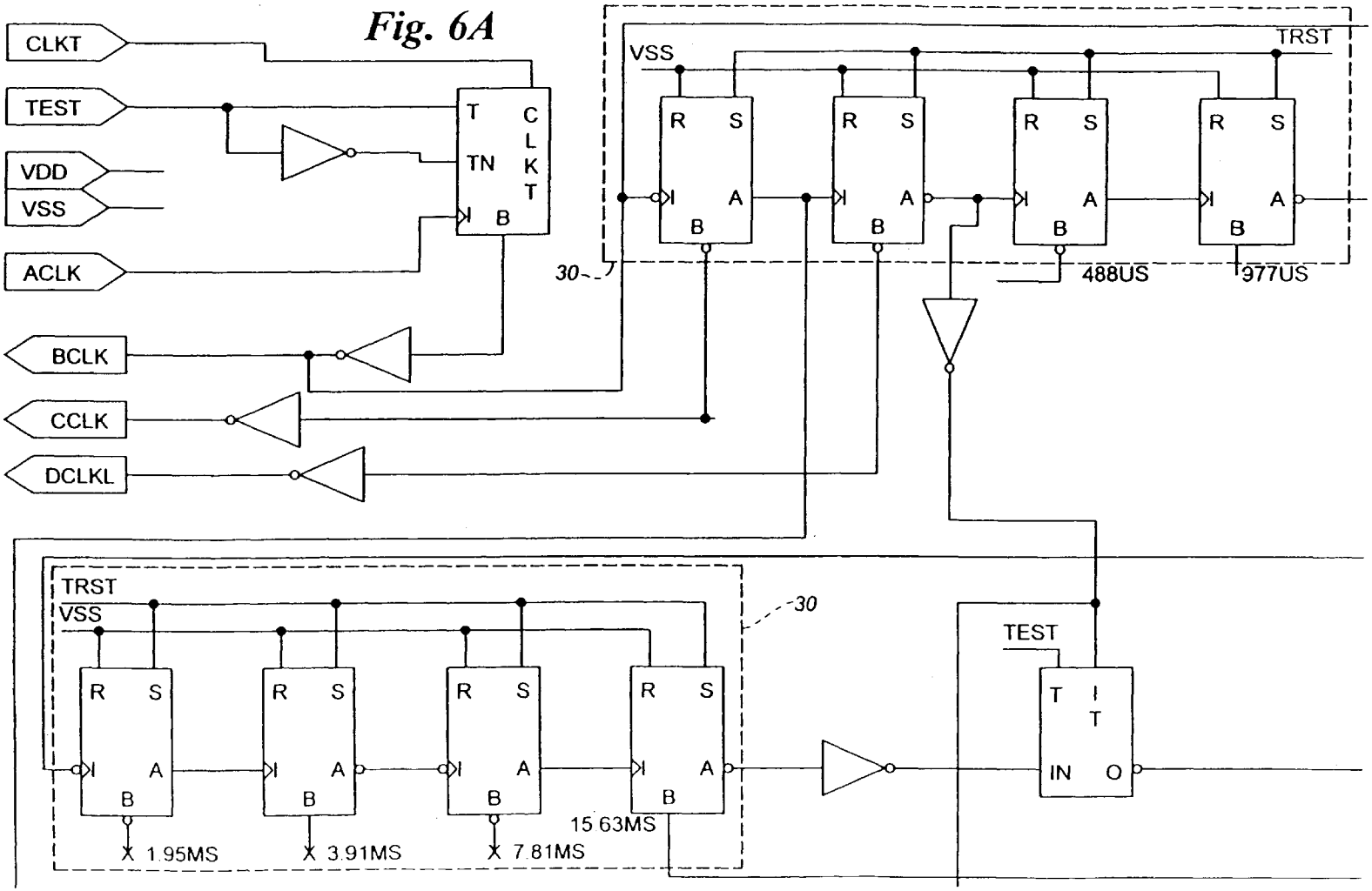
Figure 6B:
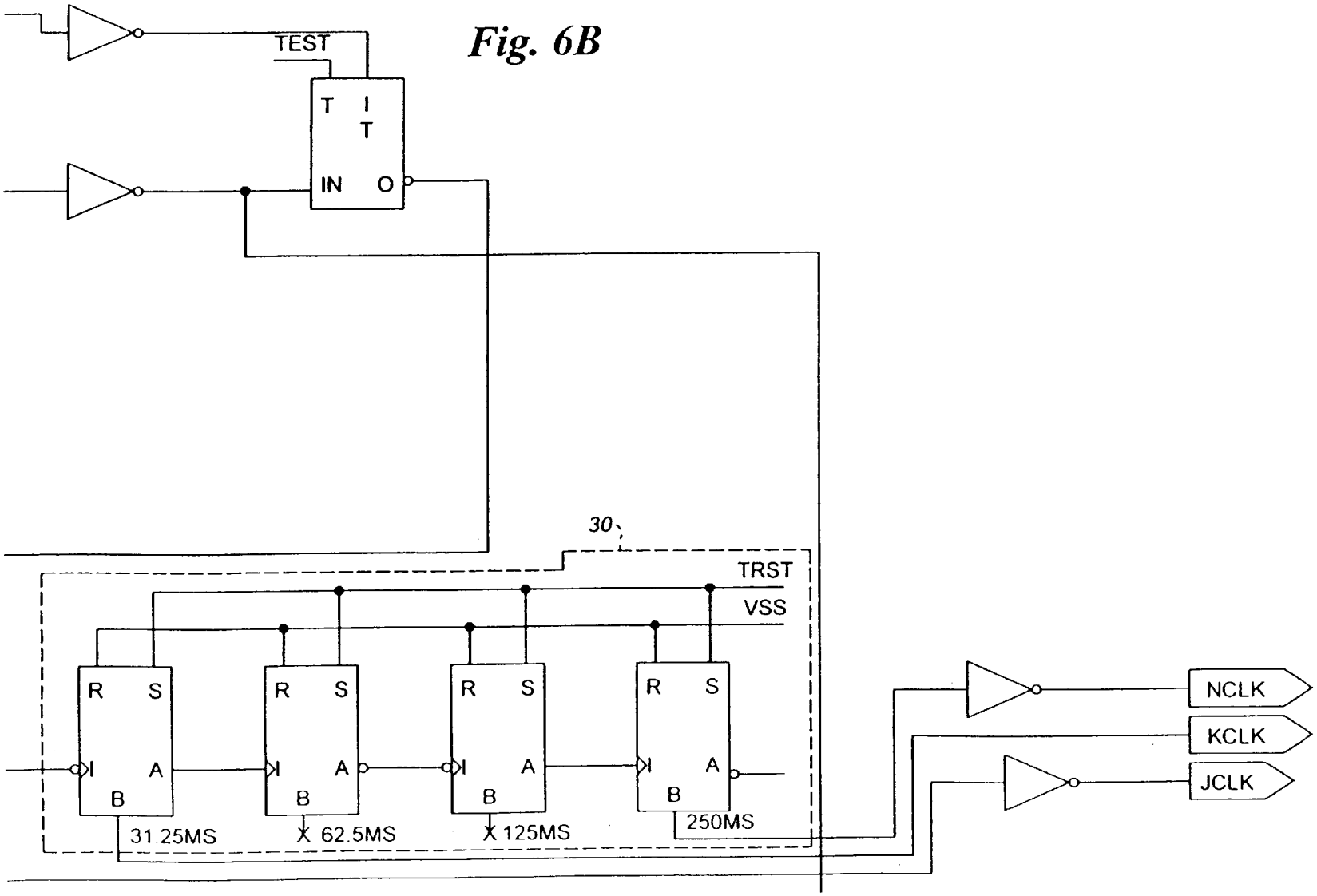
Figure 6C:
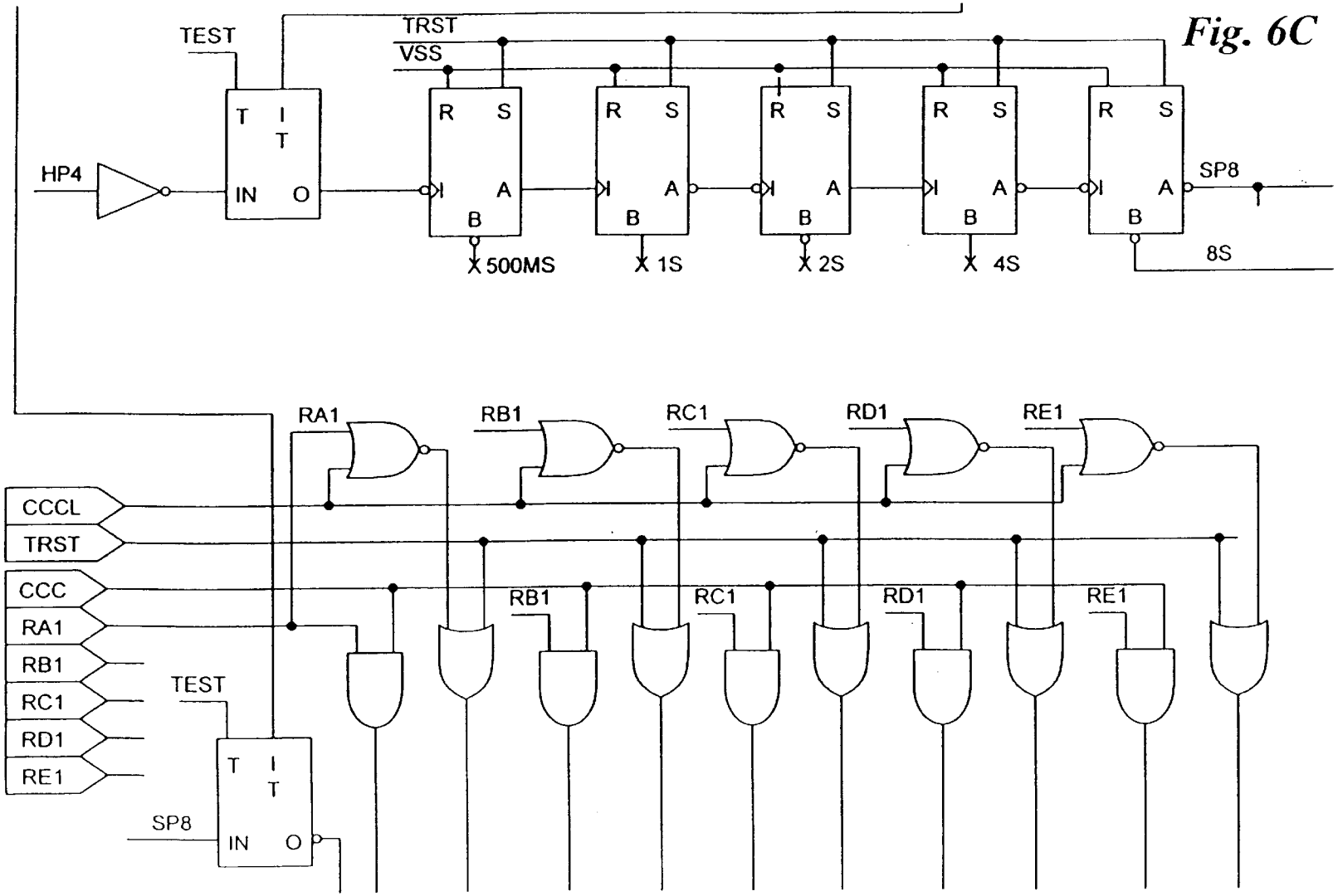
Figure 6D:
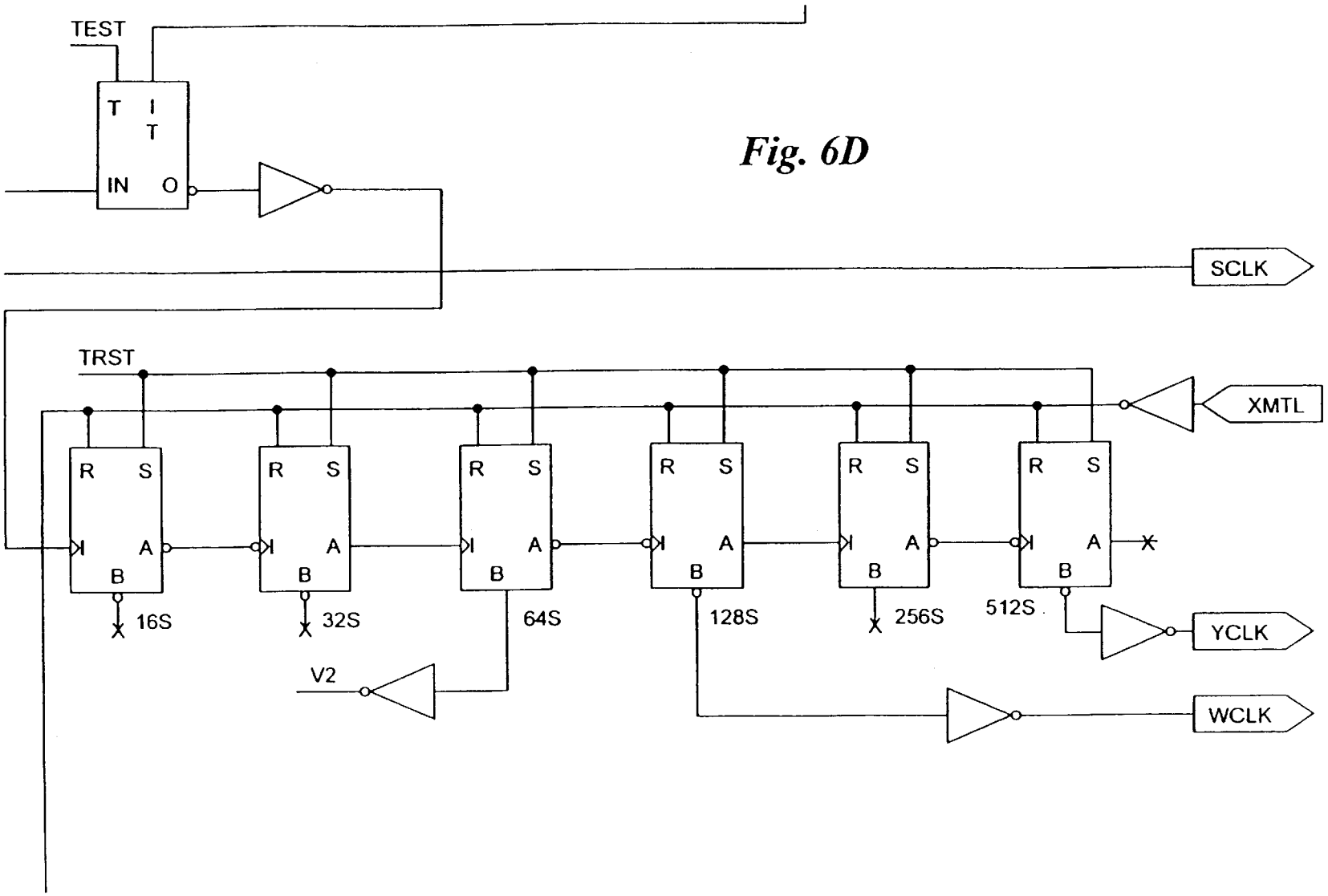
Figure 6E:
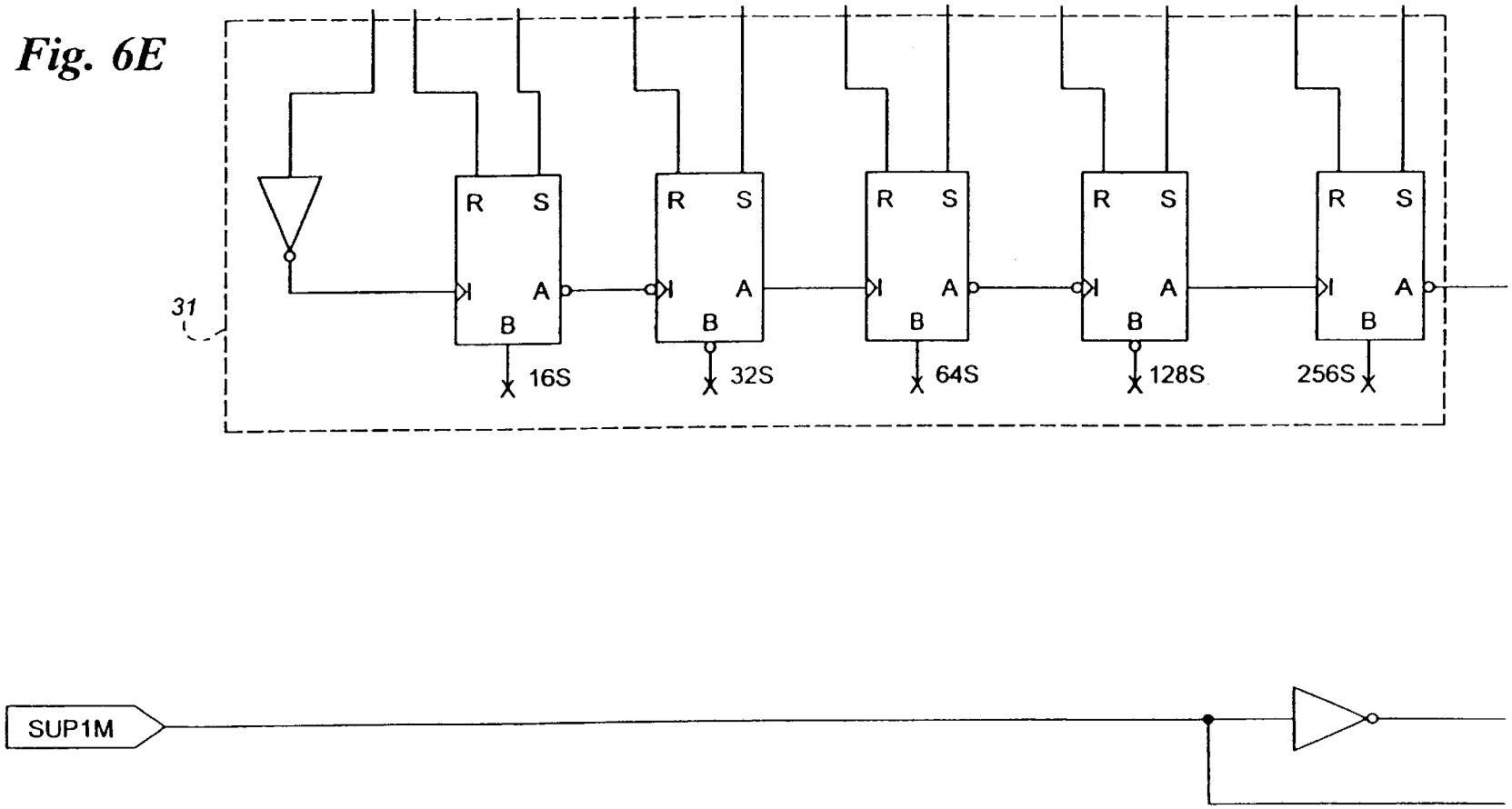
Figure 6F:
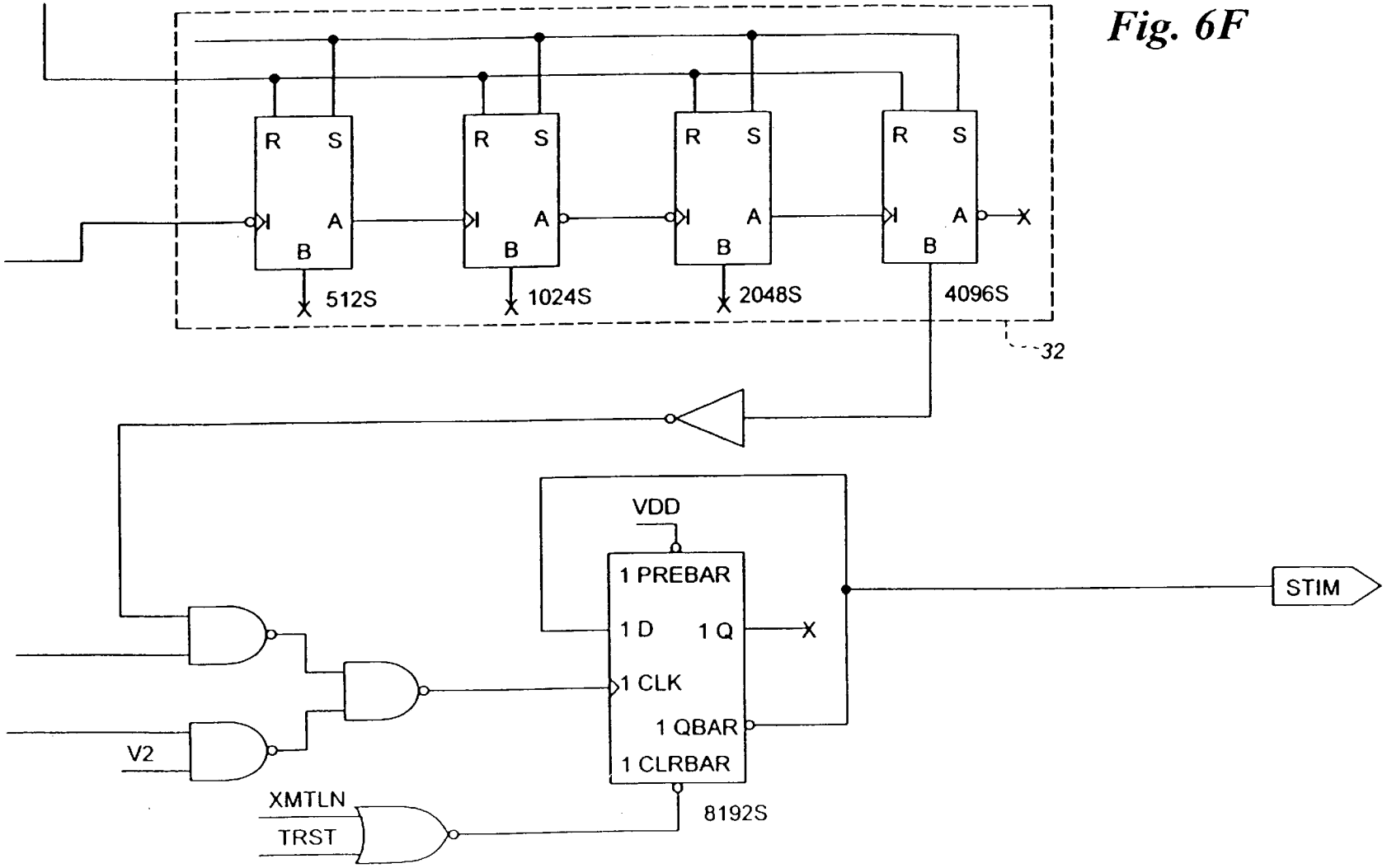
Figure 7A:
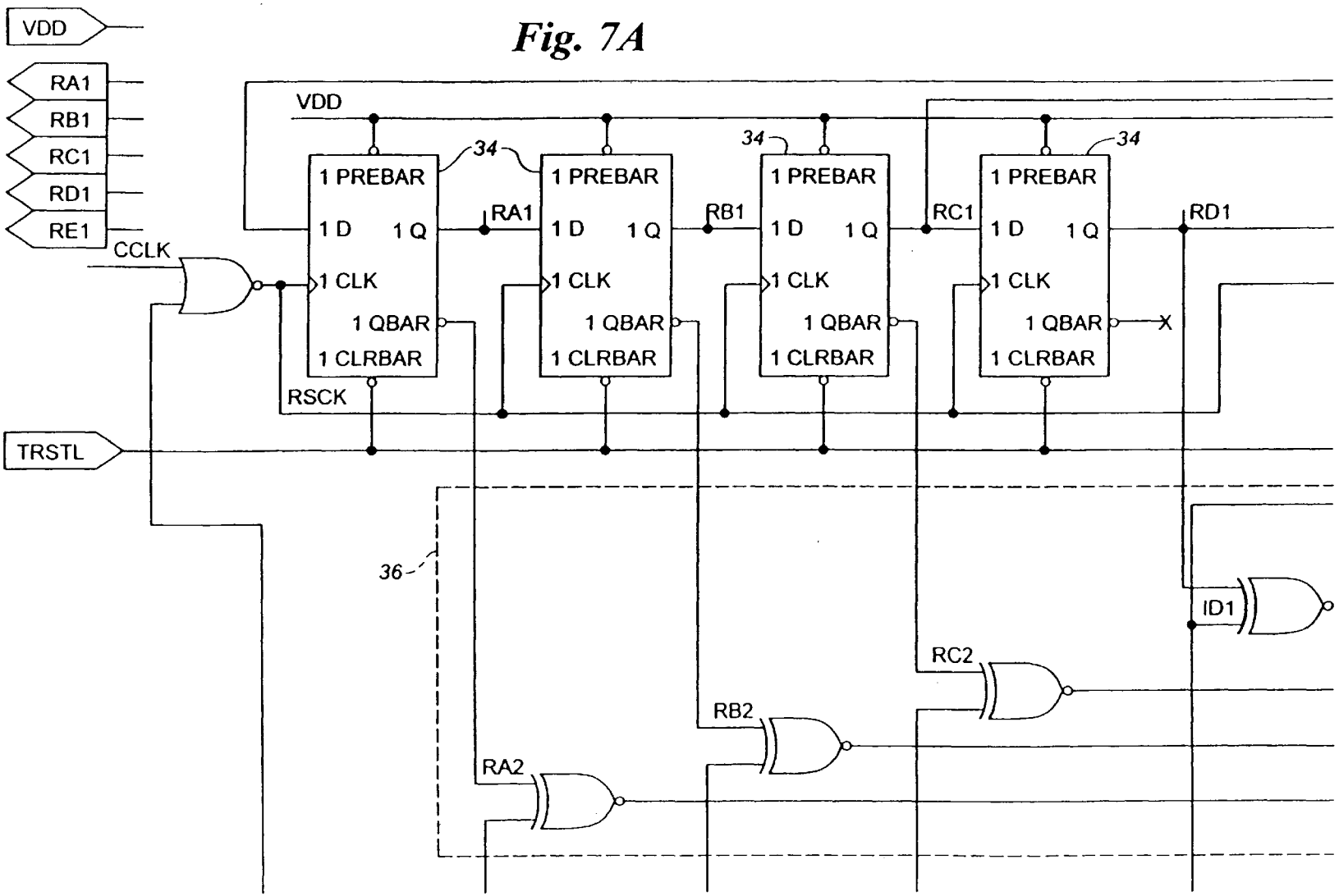
Figure 7B:
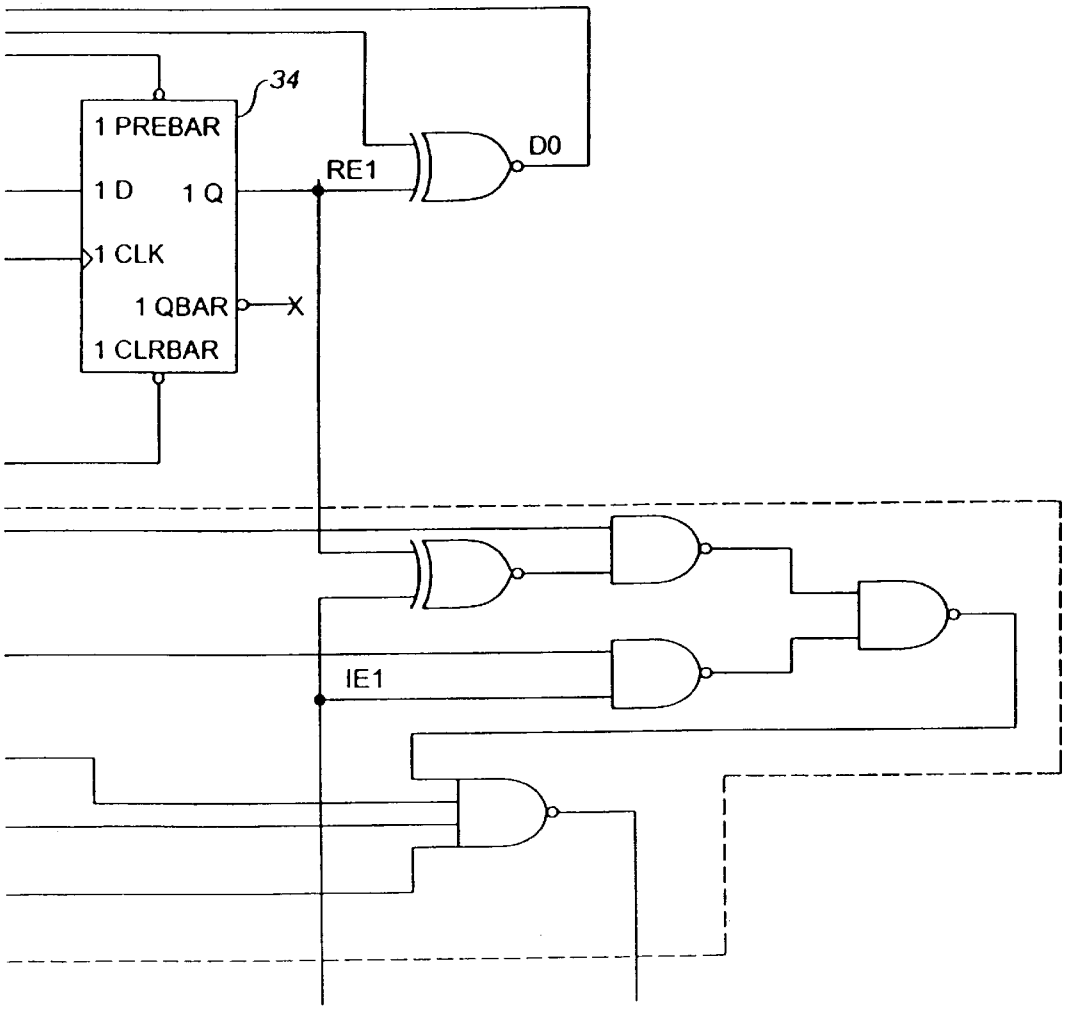
Figure 7C:
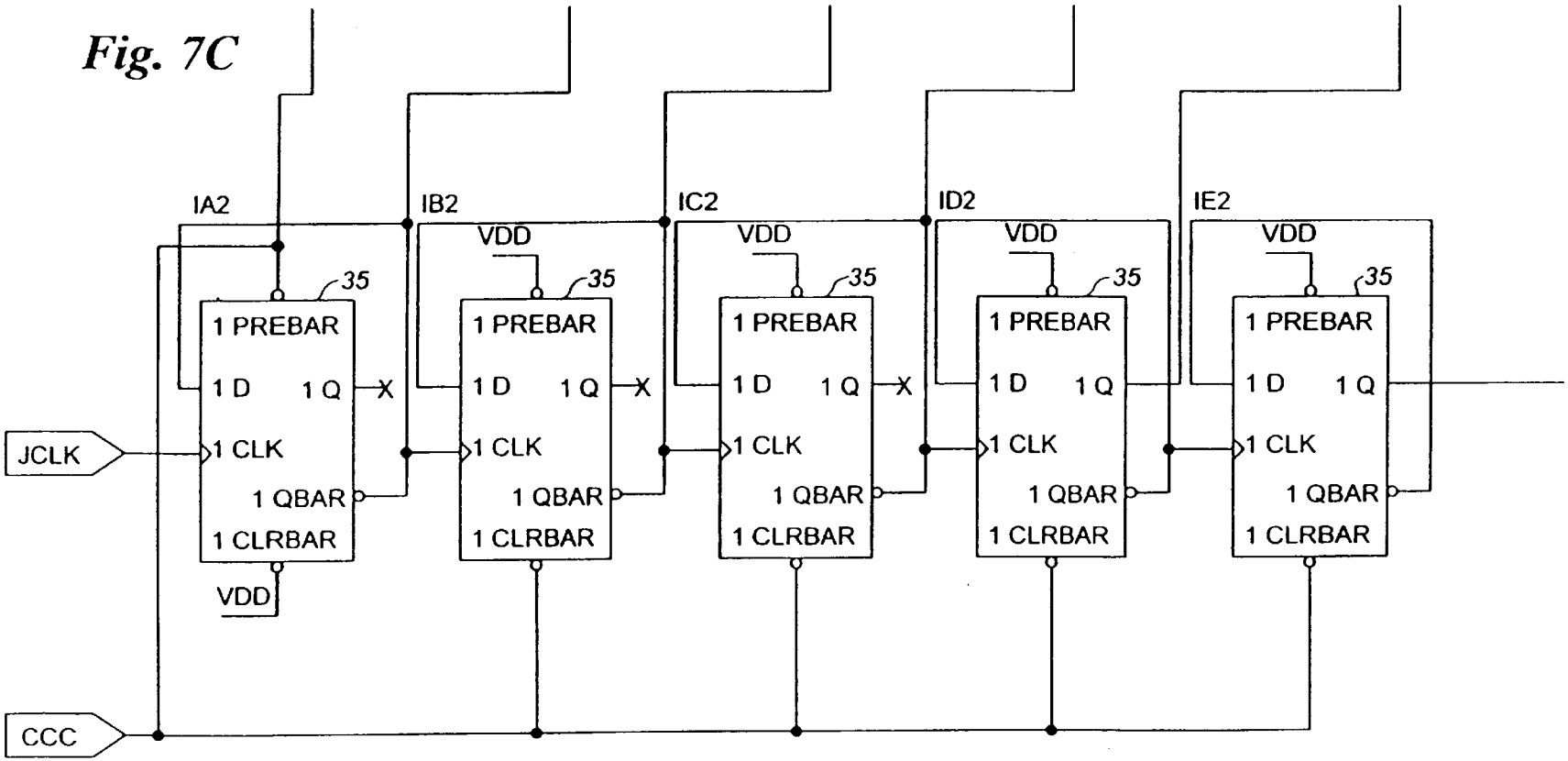
Figure 7D:
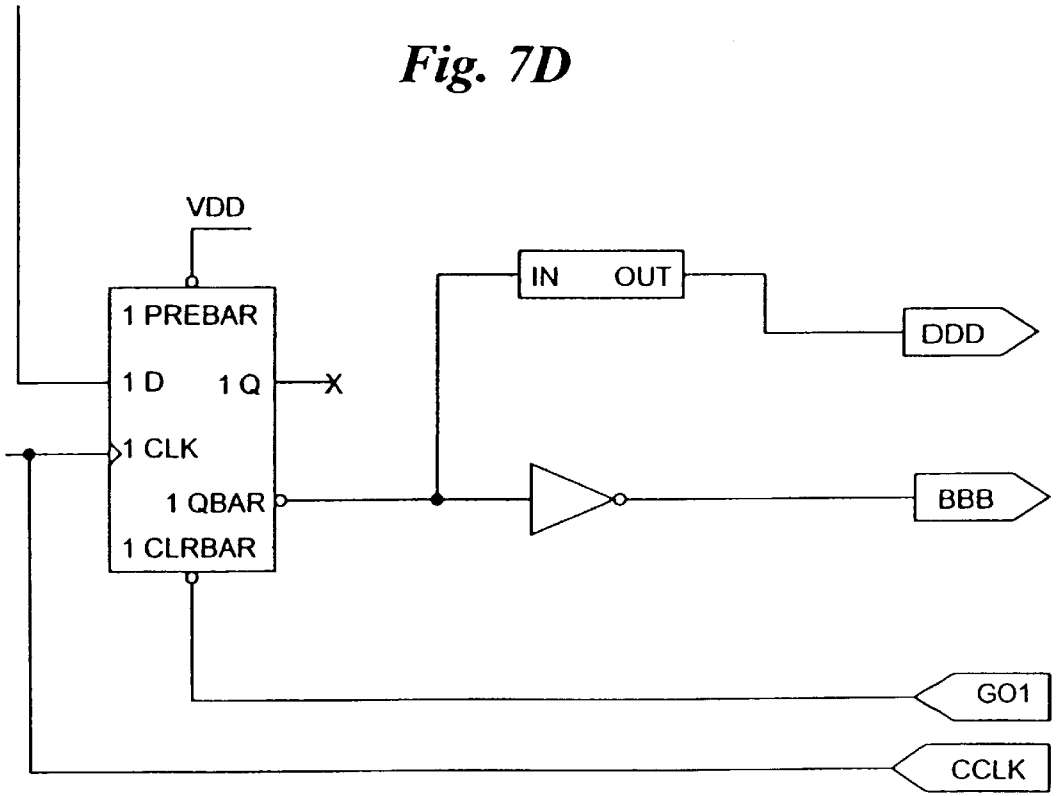
Figure 8A:
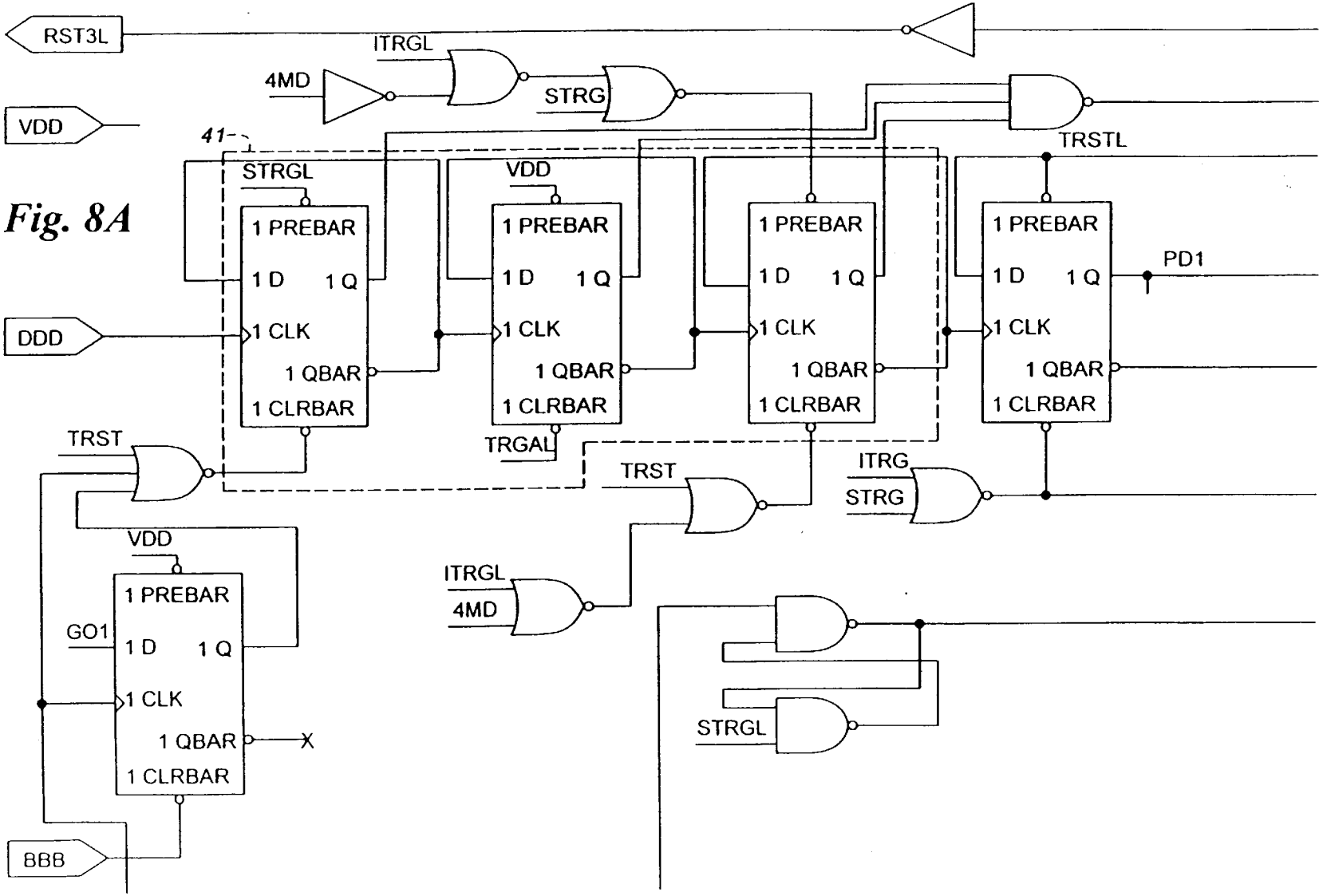
Figure 8B:
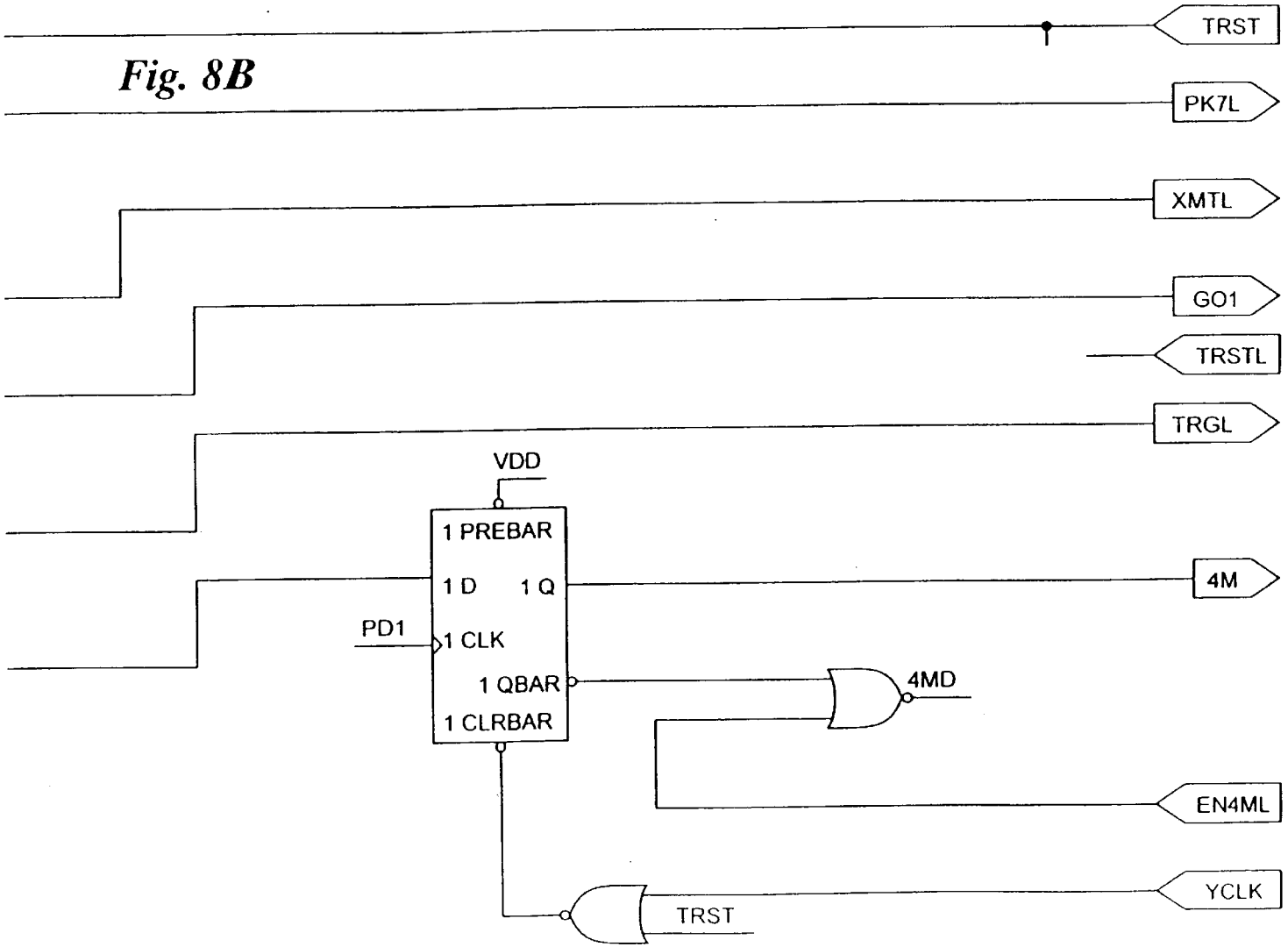
Figure 8C:
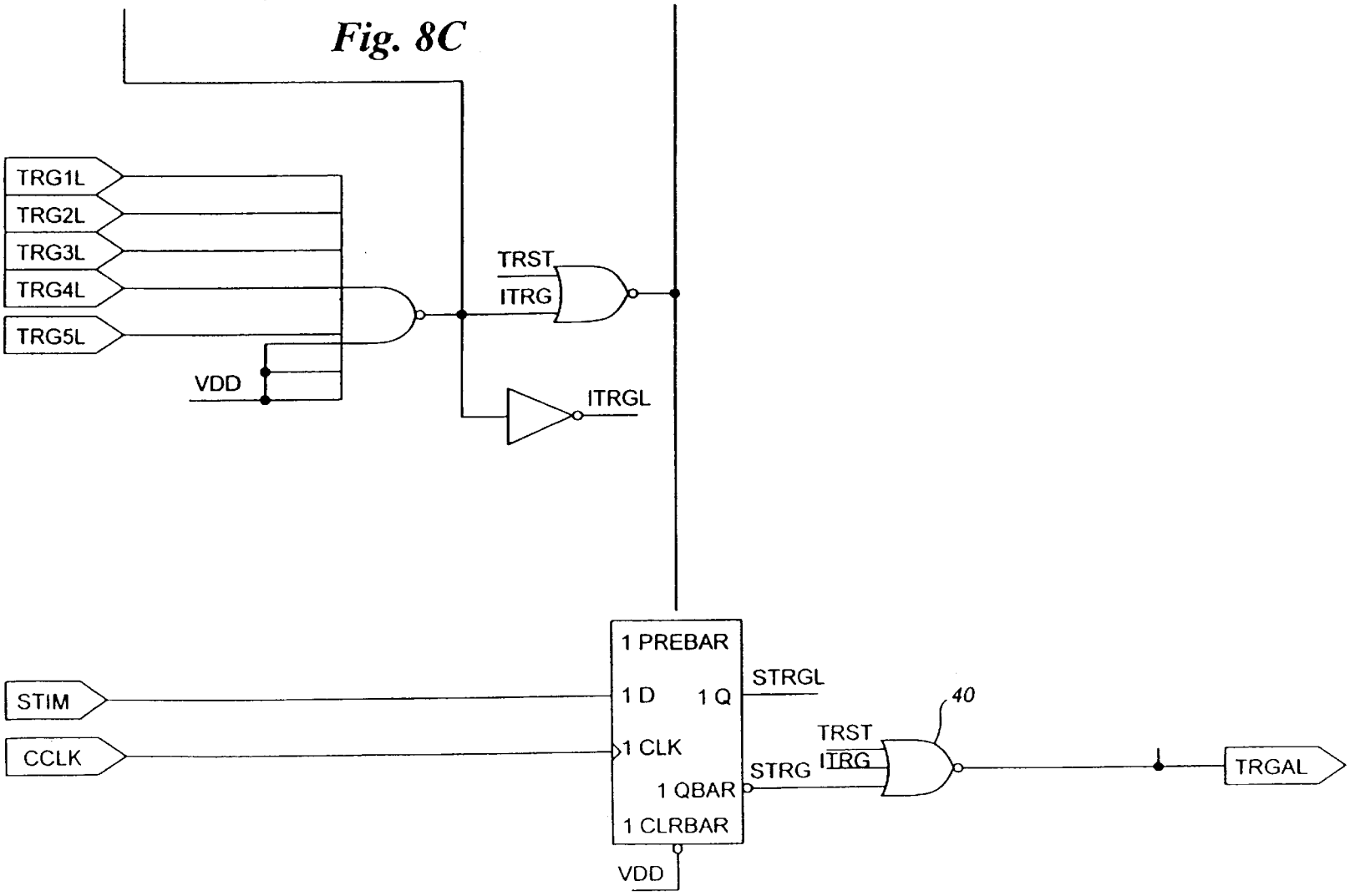
Figure 9A:
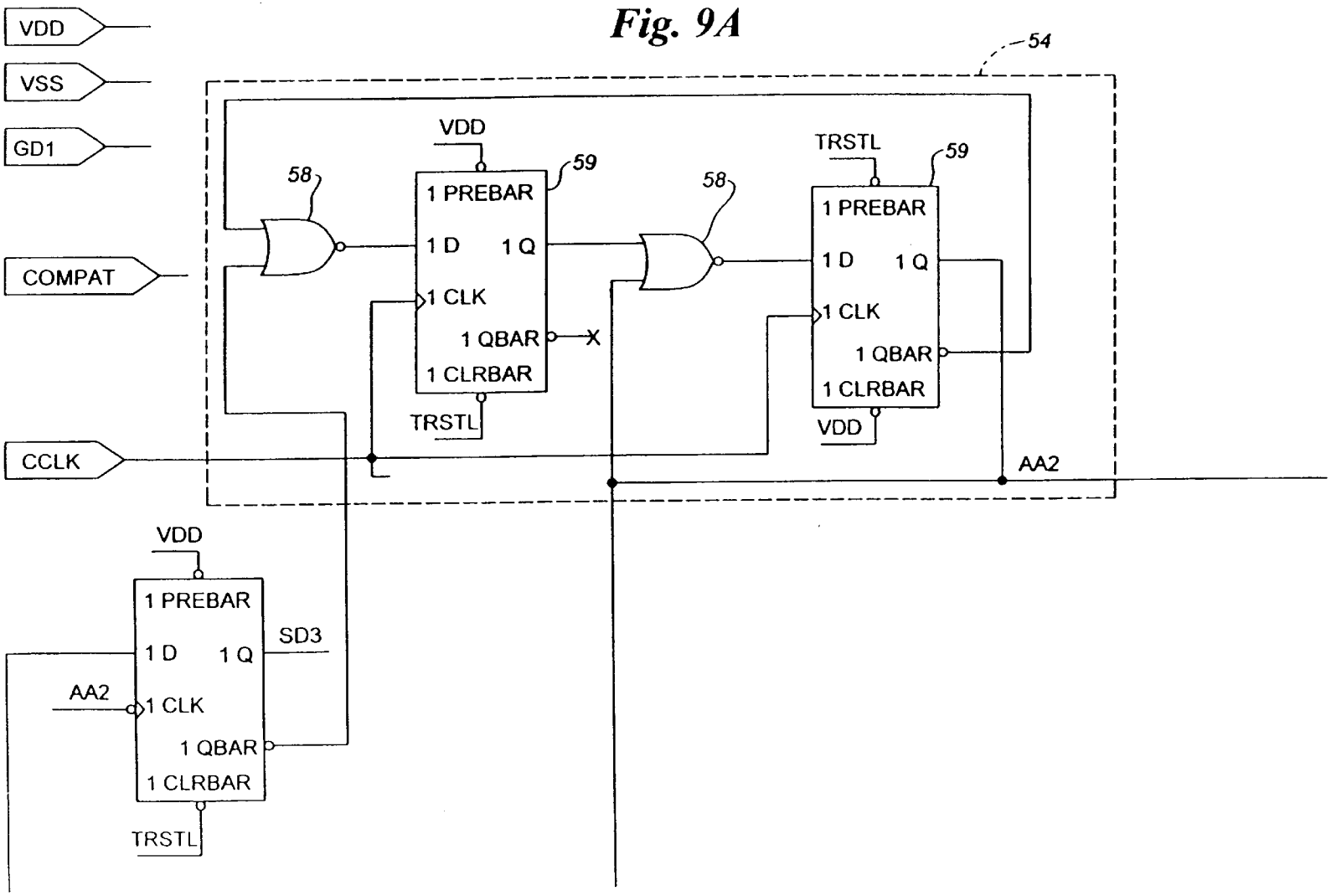
Figure 9B:
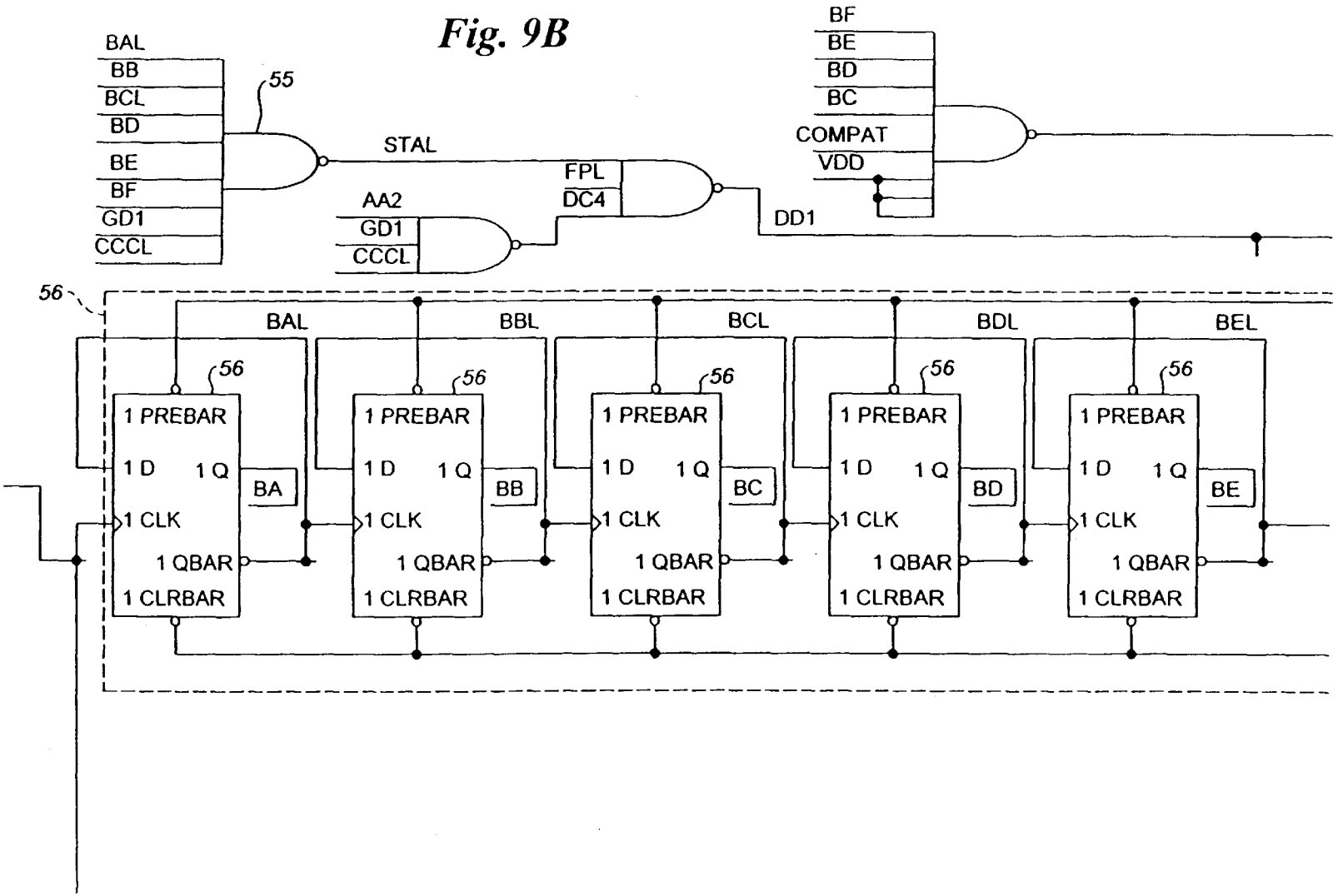
Figure 9C:
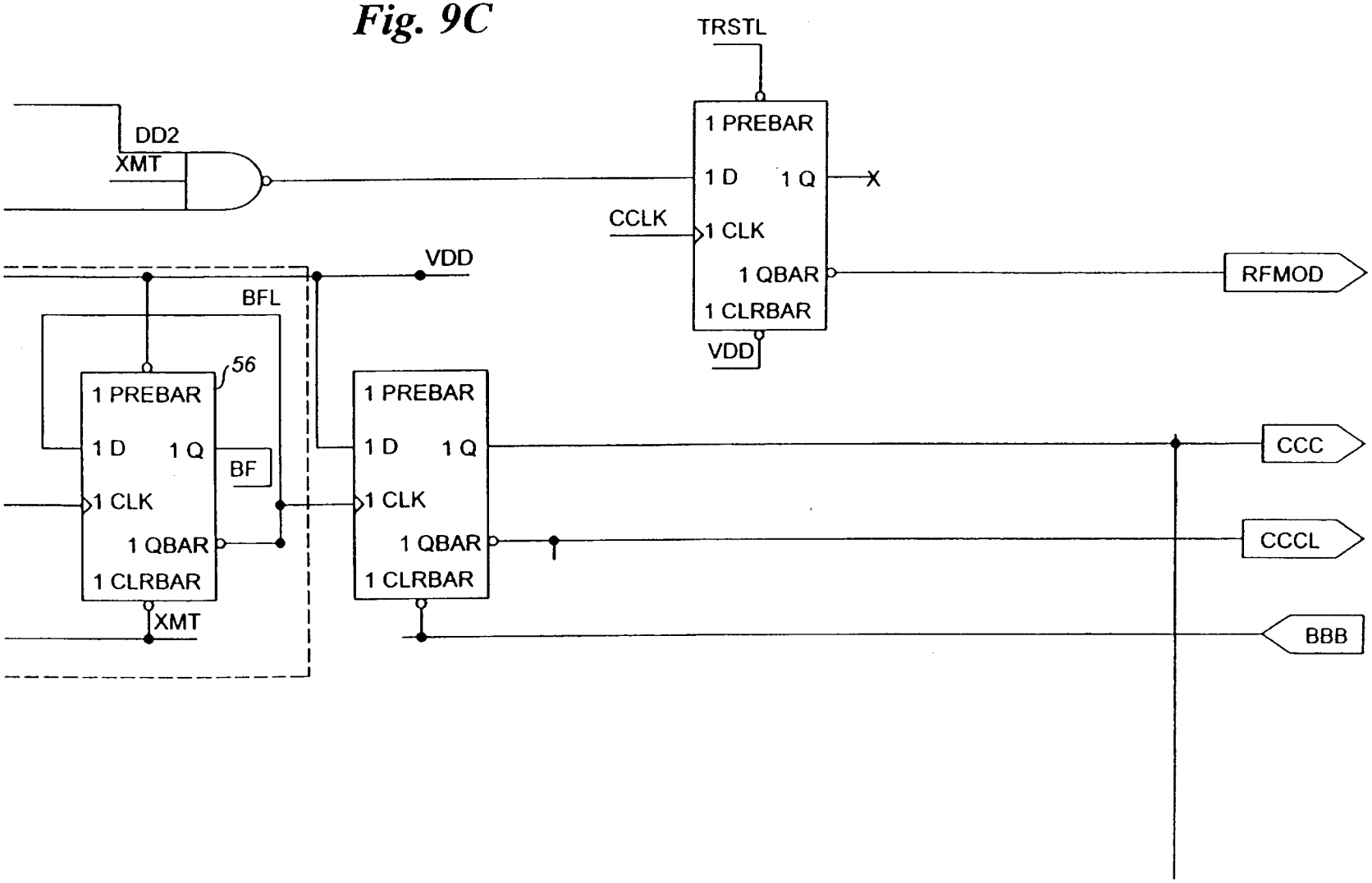
Figure 9D:
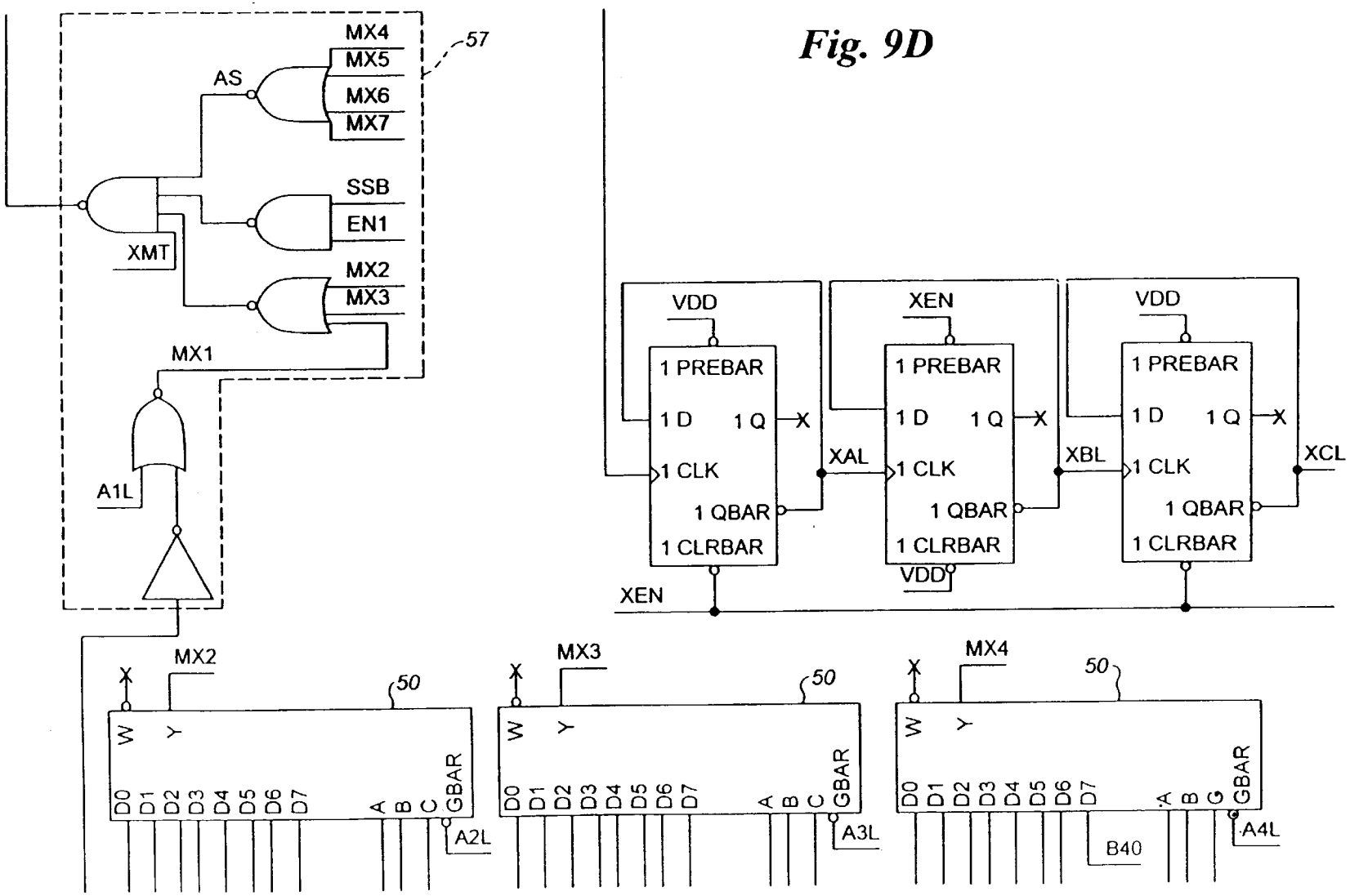
Figure 9E:
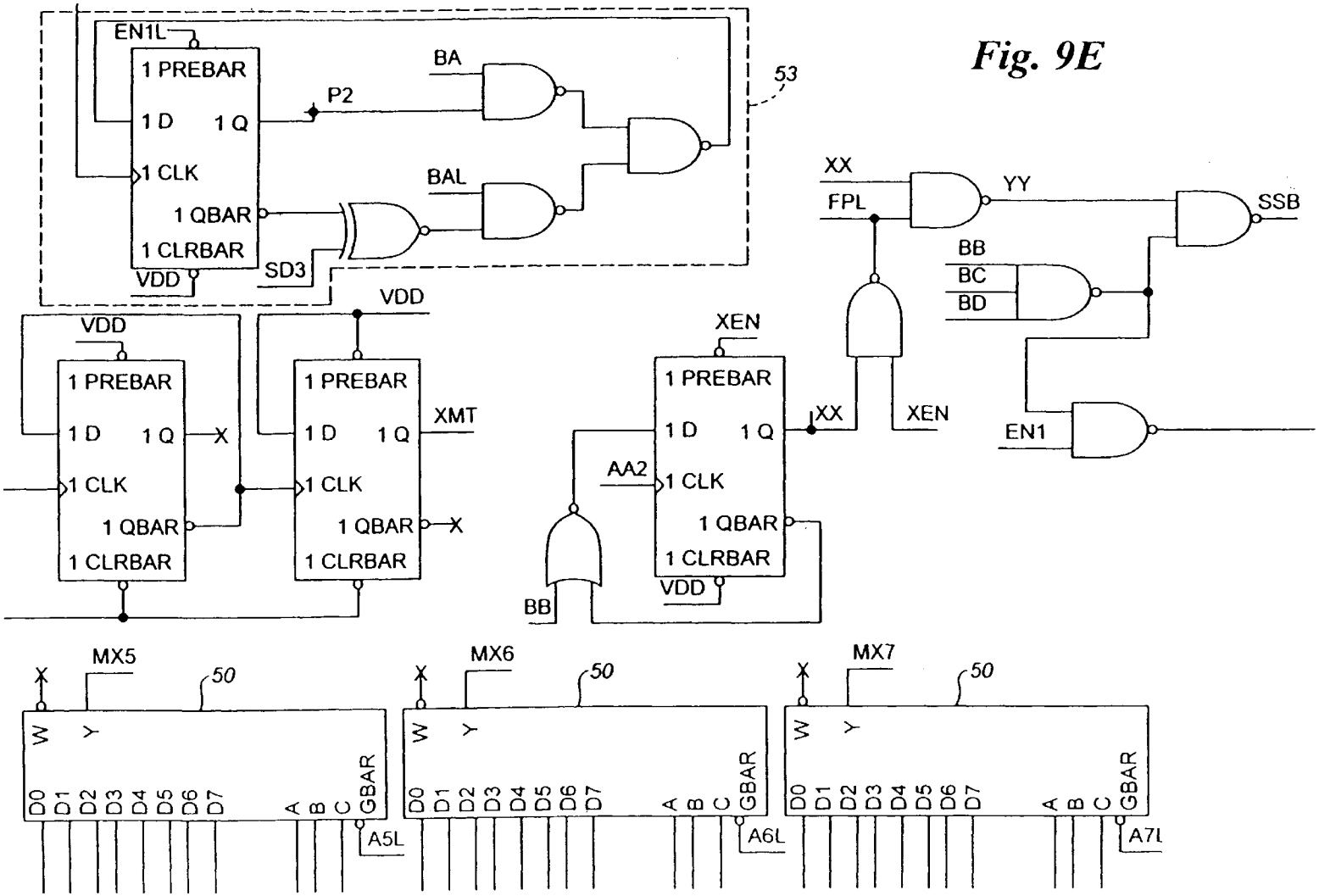
Figure 9F:
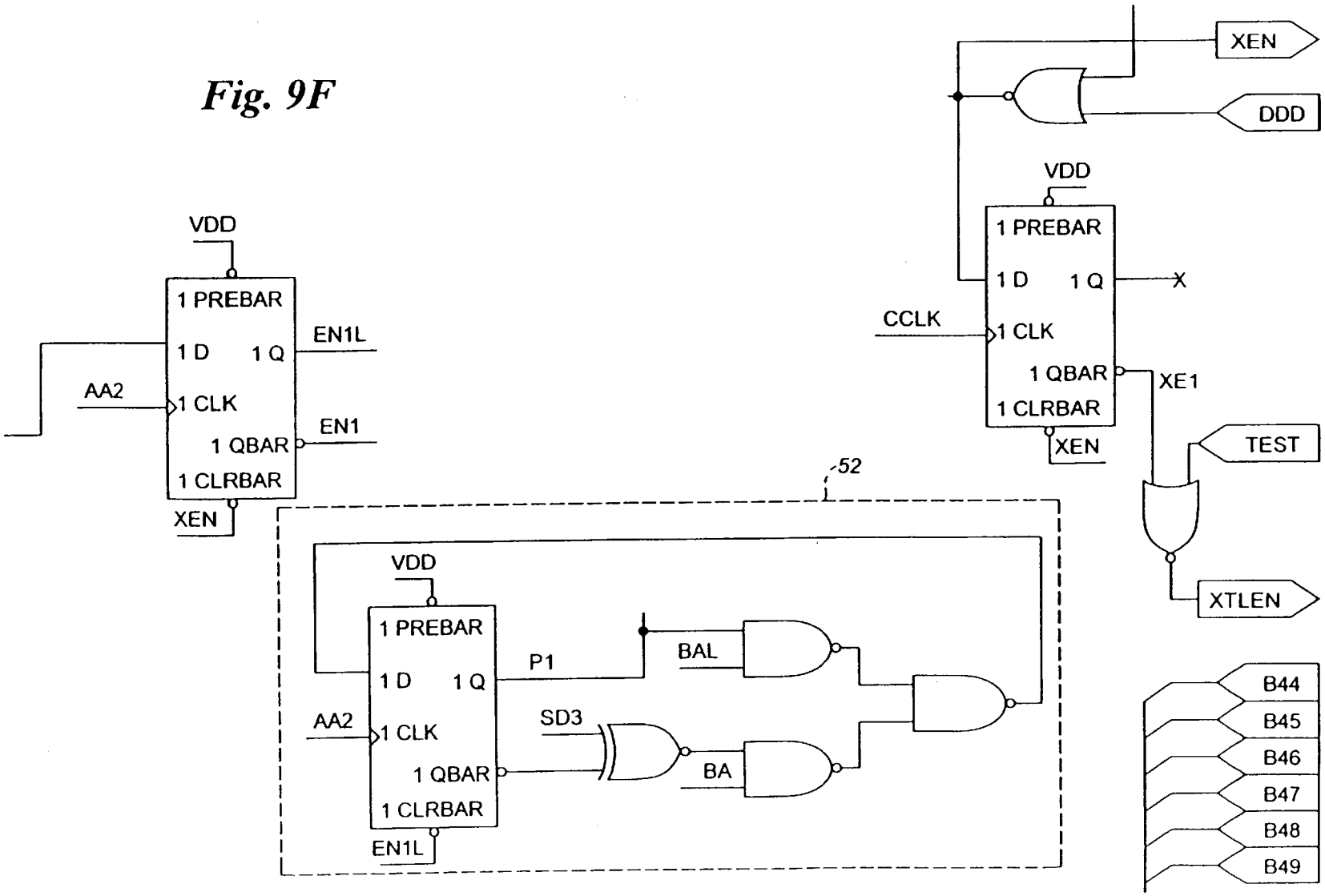
Figure 9G:
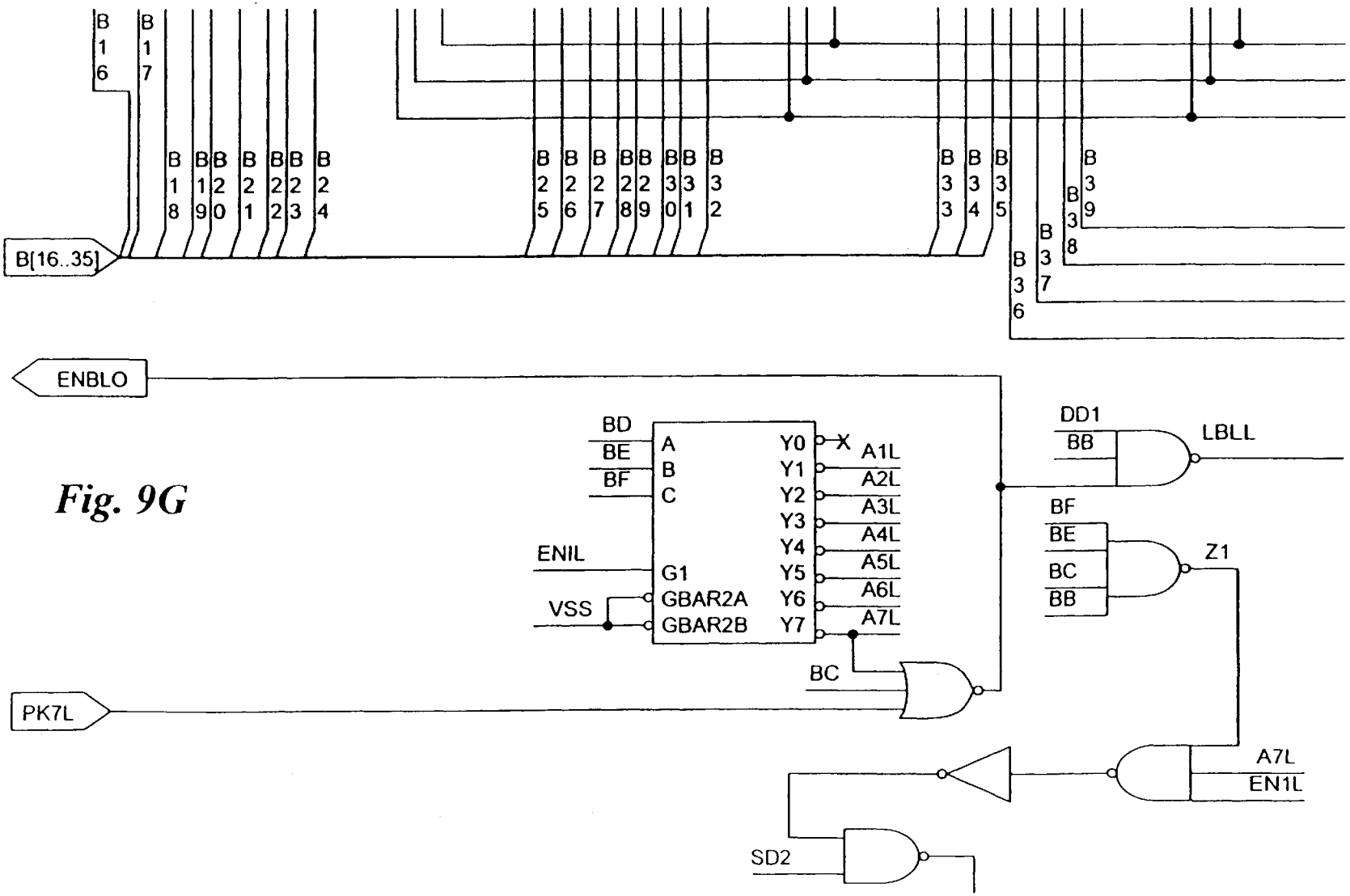
Figure 9H:
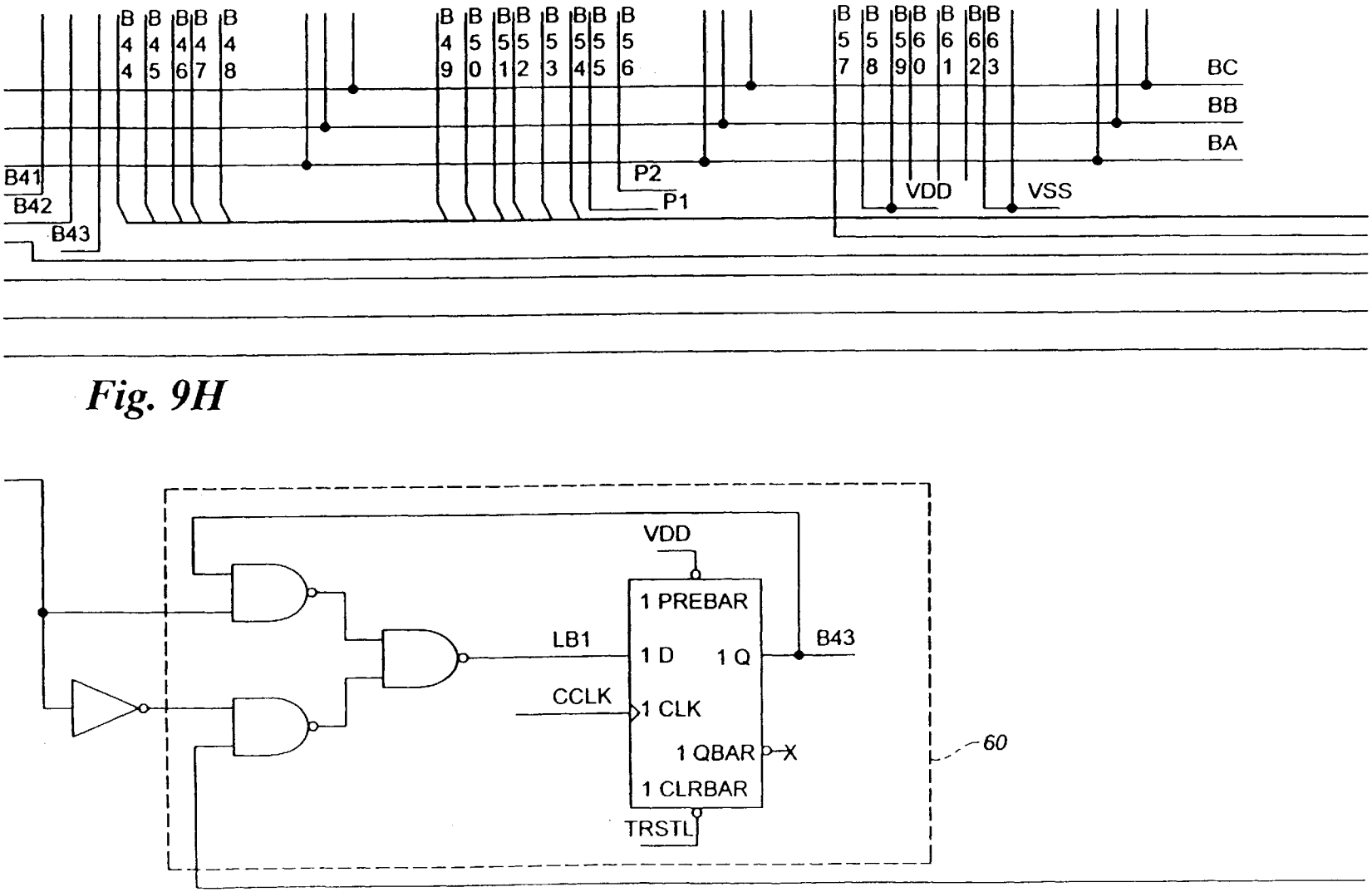
Figure 9I:
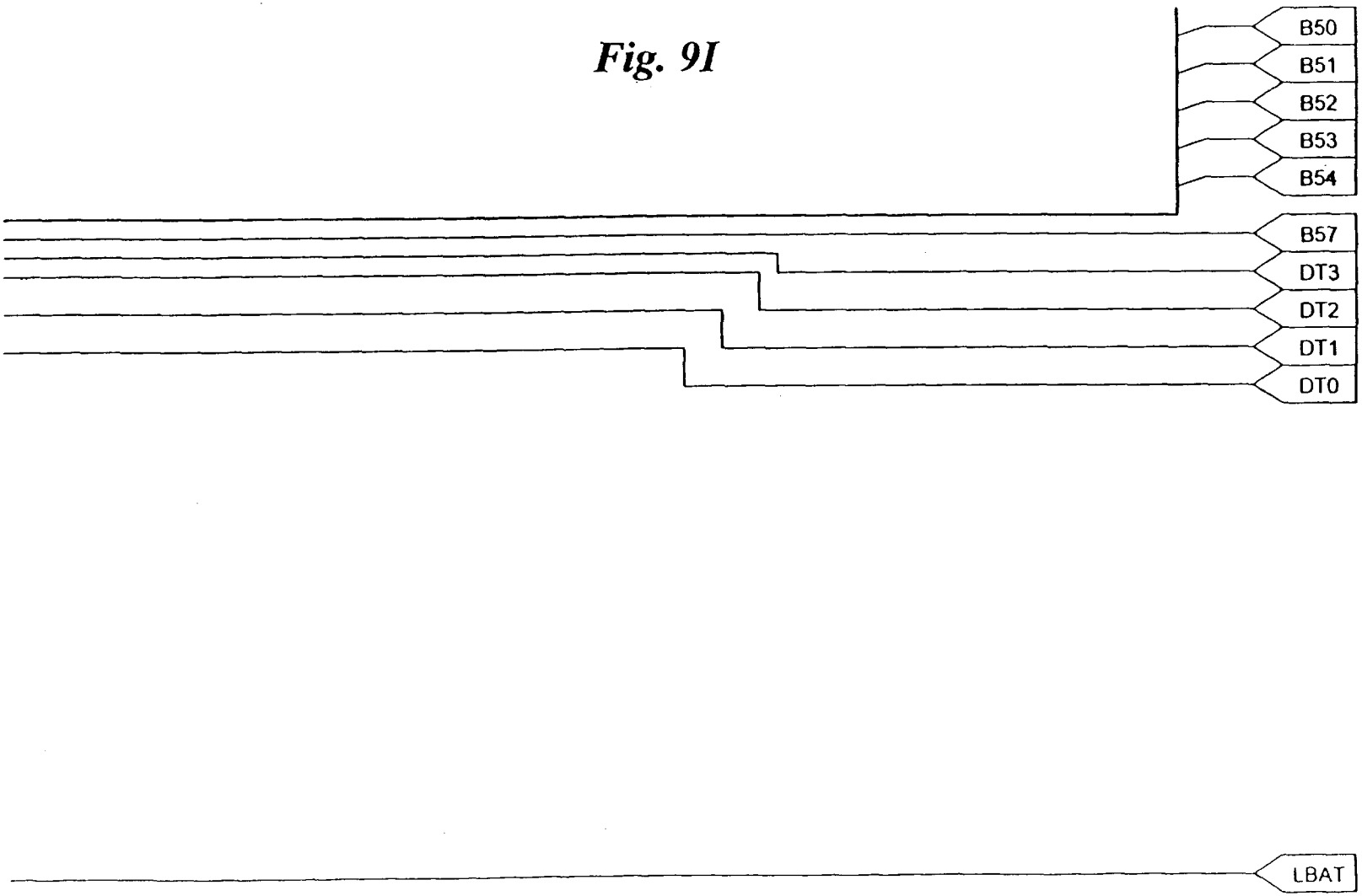
Figure 9J:
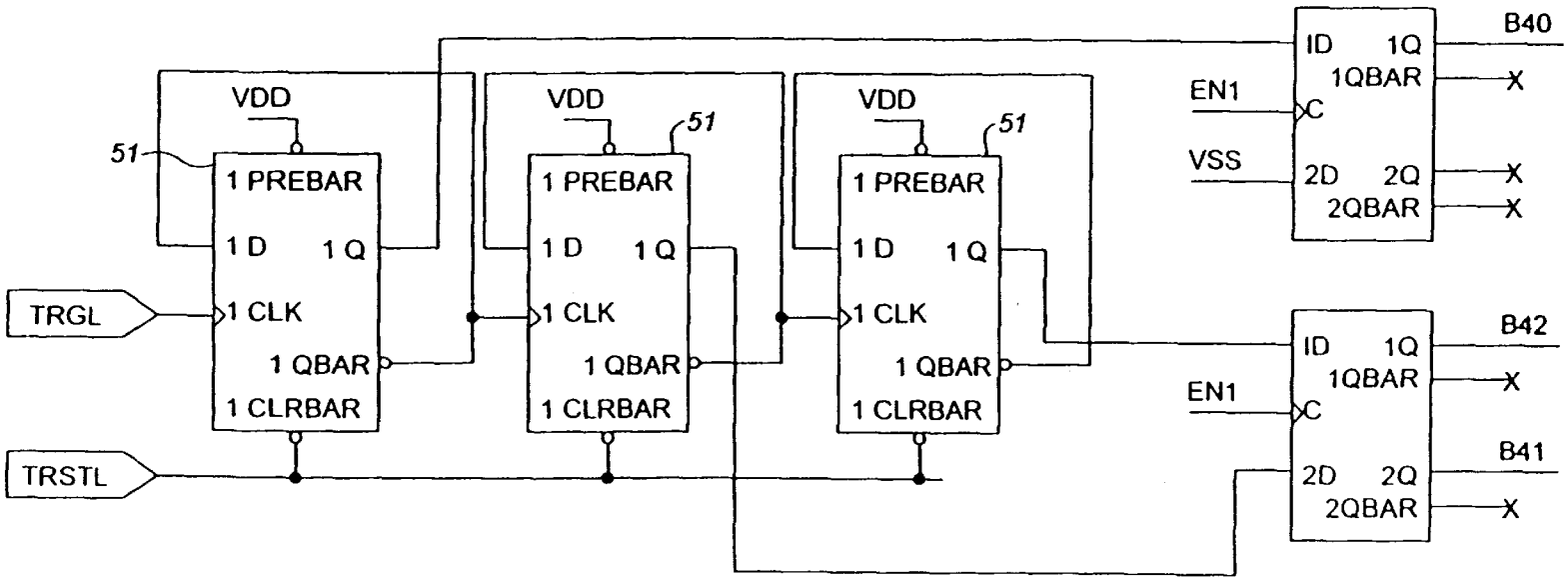
Figure 9K:
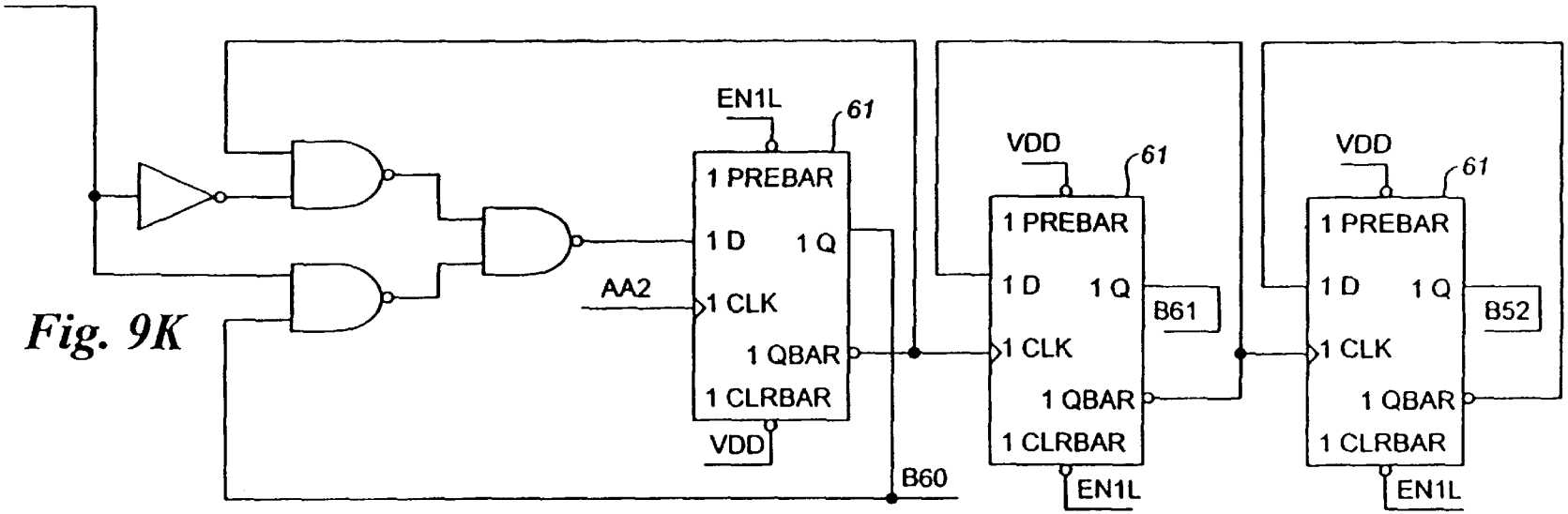

Turning to the main timer 13, as shown in FIG. 6, 32 kHz ticks are received from oscillator 134 as input ACLK. The 32 kHz signal ripples through flip-flops 30 to generate BCLK (61$\mu$s), CCLK (122$\mu$s), DCLK (244$\mu$s), NCLK (250 ms), KCLK (31.25 ms), JCLK (15.63 ms), SCLK (8 seconds), YCLK (512 seconds), and WCLK (128 seconds). Other clock signals are also generated, including 62.5 ms and 125 ms.

The lower half of FIG. 6 discloses a timer used to generate the pseudo-random supervisory timing period between sixty-four (64) and sixty-eight (68) minutes from the end of the last packet transmission. The pseudo-random period is used to prevent packet collisions at the system controller. To achieve the pseudo-random interval, interval timer 14 generates a five-bit pseudo-random number on lines RA1 through RE1 (FIG. 7). This number is sent to a two hundred and fifty-six second timer, formed by flip-flops 31, generating a period from zero to two hundred and fifty-six seconds (roughly zero to four minutes). This number is then added into flip-flops 32, to generate a pseudo-random period from 64 to 68 minutes.

Input signal XMTL resets the supervisory timer after every message packet generated by transmitter 1. When input signal SUP1M, from EEPROM 17, is a logical 1, the supervisory time period is reduced to sixty-four (64) seconds (e.g., for high security applications).

Interval timer 14 generates a pseudo-random time interval (from approximately 93 to 453 ms) between packets within a group, reducing the possibility that collisions of critical packets will occur at the system controller.

As shown in FIG. 7, flip-flops 34 function as a pseudo-random sequence generator having the sequence: 15, 08, 17, 1E, 1D, 1B, 16, 0D, 1A, 14, 09, 13, 06, 0C, 18, 10, 00, 01, 03, 07, 0E, 1C, 19, 12, 04, 08, 11, 02, 05, 0A 15 . . . This pseudo-random sequence generator is driven by timing signal CCLK from main timer 13.

The lower half of FIG. 7 discloses a counter formed by flip-flops 35 using JCLK from main timer 13 and signal CCC from transmitter logic 12. The counter is reset at the end of each packet transmission by signal CCC. The pseudo-random sequence generator is then stopped at a pseudo-random value. Gate array 36 allows the lower counter to count until the following equivalencies are met: IA1=RA1 and IB1=RB1 and IC1=RC1 and [(ID1=RD1 and IE1=1) or (IE1=RE1 and ID1=1)]. This yields a pseudo-random time interval between 93 and 453 ms. Interval timer 14 then generates end-of-interval pulses DDD and BBB, which are sent to packet counter 15 and transmitter logic 12.

Packet counter 15 works with transmitter logic 12 and interval timer 14 to determine the correct number of packets for transmission and then count the generated packets. As shown in FIG. 8, packet counter 15 has five types of inputs. Signals DDD and BBB are generated by interval timer 14 at the end of each pseudo-random time interval between packets. Signals TRG1L to TRG5L are inputs from each of the input processors 10. Signal STIM is from main timer 13 and generates a signal pulse when the supervisory time interval times out. Signal EN4ML is from EEPROM bit EP28 and enables the battery saving feature where new sensor inputs detected within 4.25 minutes of the end of the last packet transmission yield a message transmission of only four packets. Finally, packet counter 15 includes various clock inputs, including signals CCLK and YCLK.

Flip-flops 41 are used to count the number of packets for each transmission. As discussed above, normally the transmitter generates a group of eight identical message packets for each sensor input detected. In order to save the transmitter battery, the transmitter can be programmed at EEPROM bit EP28 to generate only four message packets if a change in sensor input is detected within 4.25 minutes of the end of the last packet transmission. Finally, when the supervisory period times out, only three message packets are generated for the supervisory message.

Under normal operating conditions, any one of the TRG1L to TRG5L input signals will cause flip-flops 41 to count eight packets before generating signal PK7L (discussed further below). If EEPROM bit EP28 is set to a logic 1, then the four packet feature is enabled. Therefore, if a sensor input is generated by one of TRG1L to TRG5L within 4.25 minutes of the end of the last packet transmission, flip-flops 41 will generate the signal PK7L after four packets are counted.

If there are no changes in inputs detected within the supervisory time interval, signal STIM causes flip-flops 41 to count three packets before generating signal PK7L.

Signal PK7L is sent to transmitter logic 12 and is used to latch the low battery signal (LBAT) on the stop bit of the last packet for that transmission. As discussed above, the last packet may be either the eighth, fourth, or third packet.

Packet counter 14 also generates the output signal 4M, which is used to control switching of the strong or weak pull-up resistors as discussed above regarding FIG. 4A. Signal TRGAL is sent to the EEPROM circuitry to load the EEPROM data into associated EEPROM latches. This configuration helps ensure that the correct EEPROM data is used for each set of message packets. The TRGAL signal is generated on each sensor input that generates a TRG1L to TRG5L signal, or the supervisory times out and generates the STIM signal.

The XMTL signal is sent to main timer 13 and is used to reset the flip-flops used to count the supervisory time interval. Therefore, the supervisory time interval is always counted from the last packet transmission, whether that packet transmission is based on a detected change in sensor inputs or a previous supervisory message. Signal XMTL is also sent to each of the input processors 10 and resets the latched input signal, FxLTCH, at the end of each transmission.

Signal TRGL is sent to transmit logic 12 and used to generate a three-bit trigger count.

Transmitter logic 12 is connected to the other major components of transmitter 1 to generate the message packets. As shown in FIG. 9, multiplexers 50 have as inputs the data for each packet, i.e., bits 16–63, including the device ID code (bits 16–35), device type code (bits 36–39), a "trigger" count (bits 40–42) which counts the number of times the transmitter has been triggered (either sensor or supervisory), low battery (bit 43), debounced and latched input signal FxDB and FxLTCH for each input 5 (bits 44–54), even and odd parity (bits 55 and 56), program bit (bit 57), old stop bit (bit 58), logical 1 (bit 59), modulus eight count of logical 1's in bits 15–64 (bit 60–62), and logical 0 (bit 63).

The device ID code and device type code are available from EEPROM 17. The trigger count is a three-bit value generated by flip-flops 51 using signals TRGL and TRSTL from packet counter 15. Low battery signal LBAT is received from battery tester 16 (FIG. 10). The input and latch values are received from input processors 10 for inputs 5 on lines B44 to B54.

Even and odd parity bits are output from even and odd parity generators 52 and 53, respectively. Even parity generator 52 uses the output of modulation signal generator 54 to count the odd bits (only bits 15–63) and to generate a parity bit P1 so that the sum of the odd bits and the parity bit is even. P1 is input into a multiplexer 50 and added to each message packet at bit 55.

Odd parity generator 53 also uses the output of modulation signal generator 54 to count the value of the even bits (only 16–64) and generate a parity bit P2 so that the sum of the even bits and the parity bit is odd. P2 is input into a multiplexer 50 and added to each message packet as bit 56.

The old stop bit is generated at gate 55 as 366$\mu$s off and allows the transmitter to be used with older system controllers that recognize only 58-bit message packets. Bit 59 is used as a dummy bit to clear the old stop bit, bit 58, and allow bits 60–63 to be properly processed.

Bits 60 to 62 can be used to provide error detection information that is processed by the system controller. For example, flip-flops 61 can be used to count the number of "ones" in bits 15 through 54. This count can then be processed by the system controller to determine if there are errors in the message packet.

Flip-flops 56 form a counter that counts the 64 bits of each message packet. Output signal CCC is sent to interval timer 14 to start the packet interval time delay.

Multiplexers 50 and associated gates 57, serially input data bits 15–63 into modulation signal generator 54. Modulation signal generator 54 converts the internal binary code, recognized as voltage on (1) or off (0), into the modulated binary code described above (1=122$\mu$s RF on and 244$\mu$s RF off, 0=122$\mu$s RF on and 122$\mu$s RF off). This modulation scheme is achieved by a divide-by-2 or -3 counter formed by gates 58 and flip-flops 59.

Battery tester 16 generates an output signal LBAT. When LBAT is logical 1 the battery is low and needs to be replaced or recharged. A good time to measure the battery is at the end of the transmission of a group of packets. In the block diagram of battery tester 16, shown in FIG. 10, the supply voltage is compared to a reference voltage. If the battery voltage drops too low, transmitter 1 may not function correctly and RF modulation circuit 3 may not generate a strong enough signal for the system controller to receive and decode the message packets. Therefore, each message packet includes information, at bit 43, on the status of the supply battery. When bit 43 is 0, the battery voltage is above the reference voltage, and when bit 43 is 1, the battery voltage is below the reference voltage. When the supply battery voltage is below the reference voltage, this information at bit 43 can be used by the system controller or monitoring station to warn the user that the battery must be checked.

The supply battery should be tested at a period of its lowest charge to ensure that a low battery signal is sent early enough to prevent failure of the system. The end of the transmission of the last packet was selected. Other timing points may be selected based on the desired sensitivity of the battery test function.

As discussed above, packet counter 15 generates signal PK7L at the end of transmission of the last packet. PK7L is used by transmit logic 12 to generate ENBLO. The ENBLO signal enables battery tester 16 to compare the battery voltage to the reference voltage and generate LBAT.

The LBAT signal is input into latch circuit 60 in transmitter logic 12. PK7L is also used to generate LBLL which goes low on the stop bit (bit 63) of the last packet. Latch circuit 60 then latches the LBAT signal for use in the next set of message packets.

The latched LBAT signal is not used in the last packet of the current packet transmission. If the battery is low, then the last packet may not be received or properly decoded by the system controller. The latched LBAT signal is used at bit 43 in each packet of the next group of packets transmitted (due to sensor activation or supervisory interval), increasing the probability that at least one message packet containing the low battery information will be received and properly decoded by the system controller.

Therefore, the battery level is not measured until the last message packet is being generated. The battery level is then latched and kept until the next set of message packets are generated. Then, the low battery signal is sent in this next group of message packets, increasing the probability that at least one message packet containing the low battery information will be received improperly decoded by the system controller.

Other embodiments are within the scope of the following claims.

What is claimed is:

1. A method for monitoring a parameter in a device for sending messages, the method comprising:

a) measuring a value of the parameter existing at a time during the sending of a first message by the sending device;

b) sending a second message from the sending device reporting the value of the parameter over a communication channel to a system controller, the second message being sent at a time subsequent to the sending of the first message.

2. The method of claim 1 wherein the parameter comprises an energy level.

3. The method of claim 2 wherein the energy level decreases during the sending of the first message.

4. The method of claim 1 wherein a critical value of the parameter is more likely to be reached near the end of the first message, and the measuring step includes measuring a value of the parameter at a time near the end of the sending of the first message.

5. The method of claim 4 wherein the parameter comprises an energy level, and the critical value comprises an energy level at which communication of the first message by the message sending device may not be successful.

6. The method of claim 5 wherein the first message is more likely to be successfully communicated by the message sending device when the energy level is higher than the critical value.

7. The method of claim 1 wherein the measuring comprises using a sensing device that is battery powered, and the parameter comprises the battery level, wherein a critical value of the battery level is more likely to be reached near the end of the first message.

8. The method of claim 7, wherein each of the messages comprises a group of message packets, the battery level is measured during the last packet of the first message, and the battery level is reported in the first packet of a next succeeding group of packets in the second message.

9. The method of claim 7 wherein the critical value is about 2.6 volts.

10. A method of detecting a low-power level of a sensor which sends groups of message packets, comprising:

a) measuring a power level of the sensor existing at a time during sending of a first group of message packets by the sensor; and b) sending from the sensor the measured power level as part of a second group of message packets, the second group of message packets being sent at a time subsequent to the sending of the first group of message packets.

11. The method of claim 10 wherein the measuring is done near the end of sending the first group of message packets.

12. The method of claim 10 further comprising comparing the measured power level with a predetermined reference value.

13. The method of claim 12 further comprising battery-powering the sensor and wherein the reference value is about 2.6 volts.

14. The method of claim 10 wherein the sending includes sending the power level in the first packet of a next succeeding group.

15. The method of claim 14 wherein the sending step includes sending the power level as part of each message packet of a next succeeding group.

16. A low-battery detector for a battery-powered sensor which sends messages containing message packets to a system controller, comprising:

a) a reference voltage;

b) a comparator connected to the reference voltage and a battery of the sensor, and adapted to generate an output signal indicative of the battery level; and c) a transmitter, operably connected to the comparator, for including in a group of message packets the output signal generated by the comparator, the output signal being indicative of the battery level existing a time during sending of an earlier group of message packets, wherein the group of message packets including the output signal is sent subsequent to the sending of the earlier group of message packets.

17. The apparatus of claim 16, wherein the output signal indicates whether the battery level is above or below a reference voltage.

18. The apparatus of claim 17, wherein the output signal comprises a logical 1 when the battery level is below the reference voltage and a logical 0 when the battery level is above or equal to the reference voltage.

19. The apparatus of claim 16 further including a packet counter for counting the number of packets in a group and generating a signal when the last packet in a group is counted, and wherein the comparator is enabled by the last packet signal.

20. A sensor which sends messages containing message packets to a system controller, comprising:

a packet generator for generating the message packets, a low battery detector operably connected to the packet generator, the detector comprising, a) a reference voltage, b) a comparator connected to the reference voltage and a battery of the sensor, and adapted to generate an output signal indicative of the battery level existing at a time during the generation of a first group of message packets, and wherein the packet generator includes the comparator output signal in a second group of message packets in a succeeding message generated subsequent to the first group of message packets.

21. The method of claim 11, wherein the measuring is done near the end of the last packet of the first group.

22. A low-battery detector for a battery-powered sensor which sends messages containing message packets to a system controller, comprising:

a) a reference voltage;

b) a comparator connected to the reference voltage and a battery of the sensor, and adapted to generate an output signal indicative of the battery level; and c) a transmitter, operably connected to the comparator, for including in a next succeeding group of packets the output signal generated at a time during one of the messages, wherein the transmitter includes in the next succeeding group of packets the output signal generated at a time near the end of one of the messages.

23. A sensor which sends messages containing message packets to a system controller, comprising:

a packet generator for generating the message packets, a low battery detector operably connected to the packet generator, the detector comprising:

a) a reference voltage, and b) a comparator connected to the reference voltage and a battery of the sensor, and adapted to generate an output signal indicative of the battery level, wherein the packet generator includes in a succeeding group of packets in a succeeding message the comparator output signal generated at a time near the end of one of the messages.

24. A battery-powered sensor module comprising:

a transmitter for transmitting messages containing information indicative of one or more sensor parameters;

a battery for powering the sensor module, wherein a power level of the battery generally varies from a lower power level near the end of transmission of one of the messages to a higher power level near the start of transmission of one of the messages; and a battery level indicator for indicating a power level of the battery, wherein the transmitter transmits with one of the messages battery information indicative of the power level of the battery existing at a time near the end of transmission of one of the messages, and transmits the battery information near the start of transmission of a subsequent one of the messages.

25. The sensor module of claim 24, wherein each of the messages includes a plurality of message packets, and the transmitter transmits with one of the messages battery information indicative of the power level of the battery existing at a time near the end of the last one of the message packets of one of the messages.

26. The sensor module of claim 25, wherein the transmitter transmits the battery information near the start of the first one of the message packets of a subsequent one of the messages.

27. A battery-powered sensor module comprising:

a transmitter for transmitting messages containing information indicative of one or more sensor parameters;

a battery for powering the sensor module; and a battery level indicator for indicating a power level of the battery existing at a time during transmission of a first message, wherein the transmitter transmits battery information indicative of the power level of the battery existing at the time during the transmission of the first message with a subsequent one of the messages.

28. A battery-powered sensor module comprising:

a transmitter for transmitting messages containing information indicative of one or more sensor parameters;

a battery for powering the sensor module; and a battery level indicator for indicating a power level of the battery, wherein the transmitter transmits battery information indicative of the power level of the battery existing at a time near the end of transmission of a previous one of the messages, wherein each of the messages includes a plurality of message packets, and the transmitter transmits with one of the messages battery information indicative of the power level of the battery existing at a time near the end of the last one of the message packets of one of the messages.

29. A method for monitoring a power level of a battery in a battery-powered sensor module, wherein the sensor module transmits messages containing information indicative of one or more sensor parameters, wherein a power level of the battery generally varies from a lower power level near the end of transmission of one of the messages to a higher power level near the start of transmission of one of the messages, the method comprising the steps of:

indicating the power level of the battery; and transmitting to a system controller with one of the messages battery information indicative of the power level of the battery existing at a time during transmission of a previous one of the messages.

30. A battery-powered sensor module comprising:

a sensor circuit for generating information indicative of one or more sensed conditions;

a battery for powering the sensor circuit;

a battery level indicator for indicating a power level of the battery;

a transmitter for transmitting messages containing the information generated by the sensor circuit, wherein the transmitter transmits battery information indicative of the power level of the battery existing at a time during transmission of one of the messages, the battery information being transmitted with a subsequent one of the messages.

* * * * *